US010294858B2

(12) United States Patent
Lan et al.

(10) Patent No.: US 10,294,858 B2
(45) Date of Patent: May 21, 2019

(54) PORTABLE GENERATOR

(71) Applicant: Polaris Industries Inc., Medina, MN (US)

(72) Inventors: Chun Lan, Maple Grove, MN (US); Paul J. Johnson, Maple Grove, MN (US); Kevin A. McNutt, Dresser, WI (US); Michael J. Dresen, Minneapolis, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 14/473,610

(22) Filed: Aug. 29, 2014

(65) Prior Publication Data

US 2015/0059662 A1 Mar. 5, 2015

Related U.S. Application Data

(60) Provisional application No. 61/871,748, filed on Aug. 29, 2013.

(51) Int. Cl.

| | |
|---|---|
| ***F02B 63/04*** | (2006.01) |
| *F02B 75/16* | (2006.01) |
| *F02B 77/13* | (2006.01) |

(52) U.S. Cl.

CPC ..... *F02B 63/048* (2013.01); *F02B 63/044* (2013.01); *F02B 75/16* (2013.01); *F02B 77/13* (2013.01); *F02B 2063/045* (2013.01)

(58) Field of Classification Search

CPC .. F02B 63/04; F02B 2063/045; F02B 63/044; F02B 77/13; F02B 75/16

USPC ..... 123/2

See application file for complete search history.

(56) References Cited

U.S. PATENT DOCUMENTS

| | | | | |
|---|---|---|---|---|
| 4,946,325 | A * | 8/1990 | Abraham | F16B 13/124 411/24 |
| 5,229,929 | A | 7/1993 | Shimizu et al. | |
| 5,239,253 | A | 8/1993 | Shimizu et al. | |
| 5,282,124 | A | 1/1994 | Nakamura et al. | |
| 5,309,345 | A | 5/1994 | Nakamura et al. | |
| 5,397,206 | A * | 3/1995 | Sihon | F02B 77/005 411/369 |
| 5,400,236 | A | 3/1995 | Shimizu et al. | |
| 5,444,592 | A | 8/1995 | Shimizu et al. | |
| 5,706,769 | A | 1/1998 | Shimizu | |
| 5,857,441 | A | 1/1999 | Yonezawa et al. | |
| D414,461 | S | 9/1999 | Wang | |
| 5,962,939 | A | 10/1999 | Nakamura et al. | |
| D417,651 | S | 12/1999 | Ohsumi | |
| 6,091,160 | A | 7/2000 | Kouchi et al. | |

(Continued)

FOREIGN PATENT DOCUMENTS

| | | | | |
|---|---|---|---|---|
| FR | 2665218 A3 * | 1/1992 | | F02B 63/04 |
| FR | 2665218 A3 * | 1/1992 | | F02B 63/04 |

*Primary Examiner* — Jacob M Amick

*Assistant Examiner* — Charles Brauch

(74) *Attorney, Agent, or Firm* — Faegre Baker Daniels LLP

(57) ABSTRACT

A portable engine-generator is described having an engine and a generator coupled to the engine. An engine mount has a mounting plate coupled to the engine and also includes a frame. An outer housing surrounds the engine, generator and frame. At least one handle is coupled to the outer housing. The housing is defined in three sections; a lower section, a middle section and an upper section. The three housing sections are coupled to the frame.

48 Claims, 41 Drawing Sheets

(56) References Cited

U.S. PATENT DOCUMENTS

| | | | |
|---|---|---|---|
| 6,100,599 | A | 8/2000 | Kouchi et al. |
| 6,130,486 | A | 10/2000 | Shimizu et al. |
| D437,825 | S | 2/2001 | Imai |
| 6,250,273 | B1 | 6/2001 | Ryu et al. |
| 6,378,468 | B1 | 4/2002 | Kouchi et al. |
| 6,378,469 | B1 | 4/2002 | Hiranuma et al. |
| 6,439,215 | B1 | 8/2002 | Sato et al. |
| 6,541,876 | B2 | 4/2003 | Shimizu et al. |
| 6,552,515 | B2 | 4/2003 | Shimizu et al. |
| 6,624,528 | B2 | 9/2003 | Shimizu et al. |
| 6,639,810 | B2 | 10/2003 | Shimizu et al. |
| 6,713,887 | B2 | 3/2004 | Shimizu et al. |
| D488,442 | S | 4/2004 | Fan |
| 6,717,387 | B2 | 4/2004 | Kotani et al. |
| 6,740,986 | B2 | 5/2004 | Shimizu et al. |
| 6,796,924 | B2 | 9/2004 | Katoh et al. |
| 6,937,484 | B2 | 8/2005 | Nakamura et al. |
| 6,989,655 | B2 | 1/2006 | Eguchi et al. |
| 7,068,020 | B2 | 6/2006 | Inagawa et al. |
| 7,146,962 | B2 | 12/2006 | Sugimoto et al. |
| 7,177,163 | B2 | 2/2007 | Eguchi et al. |
| D597,485 | S | 8/2009 | Ma |
| 7,705,478 | B2 | 4/2010 | Hirose et al. |
| 7,743,739 | B2 | 6/2010 | Kochi et al. |
| D620,886 | S | 8/2010 | Flattinger et al. |
| 7,779,793 | B2 | 8/2010 | Ito et al. |
| D630,581 | S | 1/2011 | Xu et al. |
| 7,965,063 | B2 | 6/2011 | Hashimoto et al. |
| 8,066,788 | B2 | 11/2011 | Kobayashi et al. |
| 8,102,066 | B2 | 1/2012 | Hashimoto et al. |
| 2008/0054858 | A1* | 3/2008 | Uchimi ..... F02B 63/04 322/17 |
| 2011/0242769 | A1* | 10/2011 | Trine ..... H05K 5/0021 361/728 |

* cited by examiner

PORTABLE GENERATOR

CROSS-REFERENCE TO RELATED APPLICATION

This application claims the benefit of U.S. Application Ser. No. 61/871,748, filed on Aug. 29, 2013, the disclosure of which is expressly incorporated herein by reference.

BACKGROUND AND SUMMARY OF THE DISCLOSURE

The present disclosure generally relates to a portable generator having an engine driven generator.

It is well known to have portable generators. These items typically are used in remote areas for camping and the like; or in emergency situations when power is lost. The portable generator typically includes a fuel driven engine driving a small generator, where a power output is provided to receive power in the form of AC power, for example a standard three prong plug for use in the U.S., or other electrical interfaces for use outside of the U.S.

In one embodiment, a portable engine-generator comprises an engine; a generator coupled to the engine. An engine mount comprises a mounting plate coupled to the engine. An outer housing surrounds the engine, generator and a frame, and the outer housing has at least a lower housing base portion and an upper cover portion. The mounting plate is coupled to the lower housing base portion and the frame is coupled to the lower housing base portion and the upper cover portion.

In another embodiment, a portable engine-generator comprises an engine and a generator coupled to the engine. An engine mount comprises a mounting plate coupled to the engine and a frame. An outer housing surrounds the engine, generator and frame. At least one handle is coupled to the outer housing.

The above mentioned and other features of the invention, and the manner of attaining them, will become more apparent and the invention itself will be better understood by reference to the following description of embodiments of the invention taken in conjunction with the accompanying drawings.

DETAILED DESCRIPTION OF THE DRAWINGS

Figure 1:
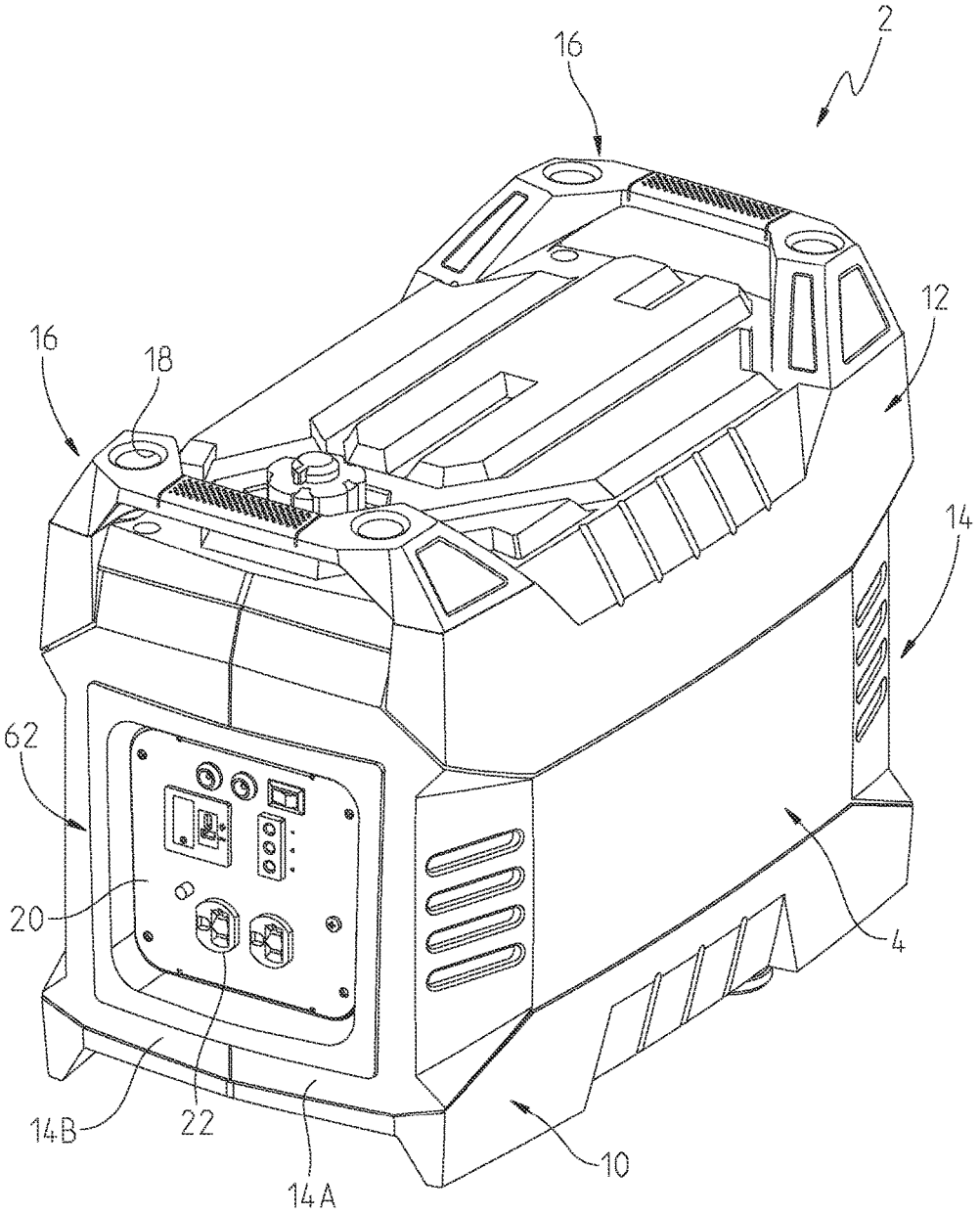
FIG. 1 is a front perspective view of the portable generator of the present application.

Corresponding reference characters indicate corresponding parts throughout the several views. Unless stated otherwise the drawings are proportional. The embodiments disclosed below are not intended to be exhaustive or to limit the invention to the precise forms disclosed in the following detailed description. Rather, the embodiments are chosen and described so that others skilled in the art may utilize their teachings.

Figure 9:
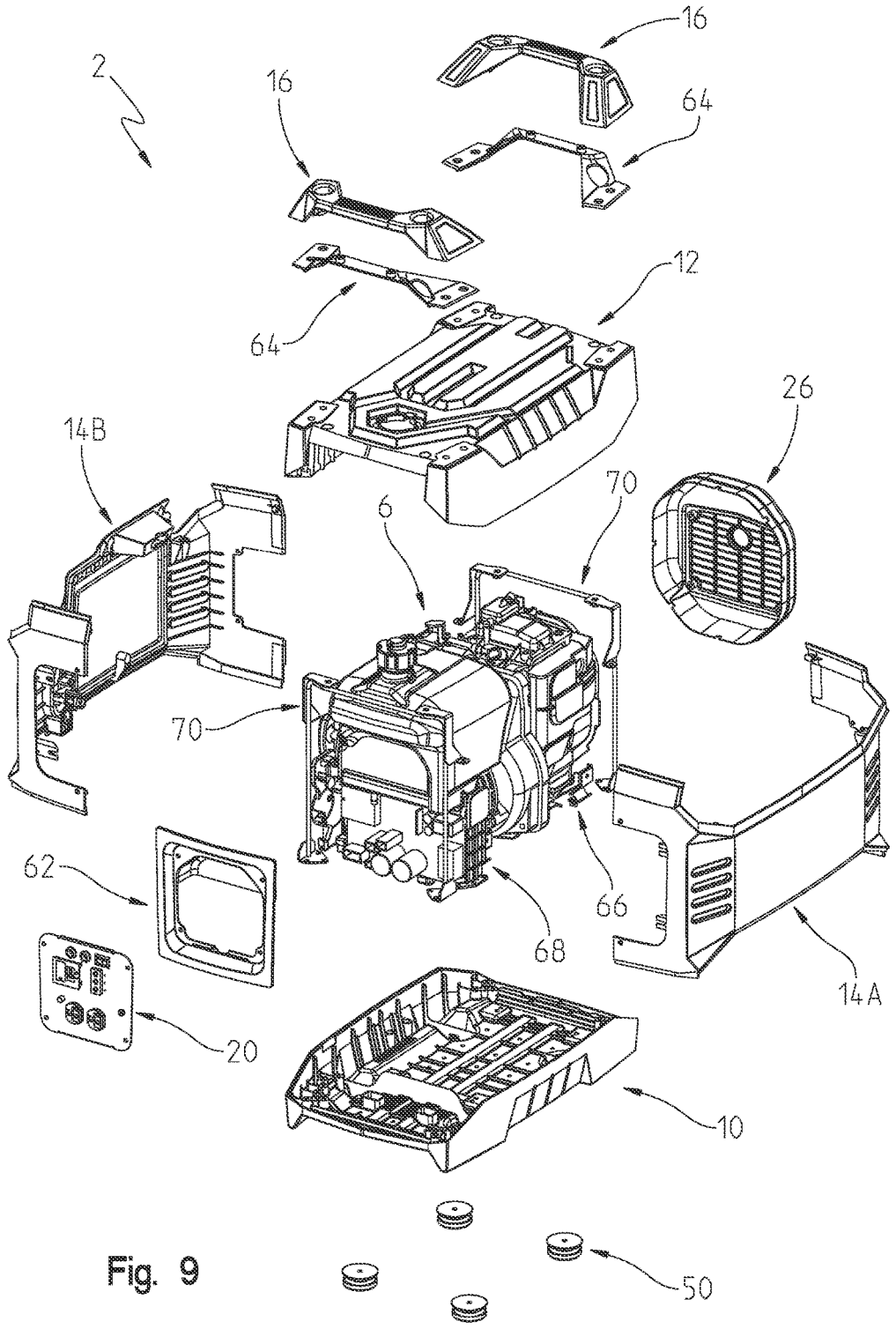
FIG. 9 is a view similar to that of FIG. 1 showing the various components of the portable generator in an exploded manner.

With reference first to FIGS. 1-9, a portable generator is shown generally at 2, which includes an outer housing 4 enclosing an engine-generator 6 (FIG. 9). Outer housing 4 generally comprises a lower housing base portion 10, an upper cover portion 12, and a middle housing portion 14 comprised of housing sections 14*a*, 14*b*. Handles 16 are coupled to the upper cover portion 12 for lifting the engine generator 2. Two handles 16 are positioned on opposite ends of engine-generator 2 in order that a single user can pick up the unit with both hands or, alternatively, two persons can carry the unit with one hand each.

Handles 16 include apertures at 18, which are profiled to receive an expansion joint similar to Applicants' Lock & Ride® locking members. Thus, any accessory, which is used with the engine-generator 2 or which is drawing power from the engine-generator 2, could be coupled directly to the handle by way of an expansion joint in aperture 18 as described further herein. For example, a user can have a trouble light having a Lock & Ride® locking member attached to an end thereof, and the trouble light could be mechanically attached to the generator 2, and electrically connected to a power outlet.

Figure 2:
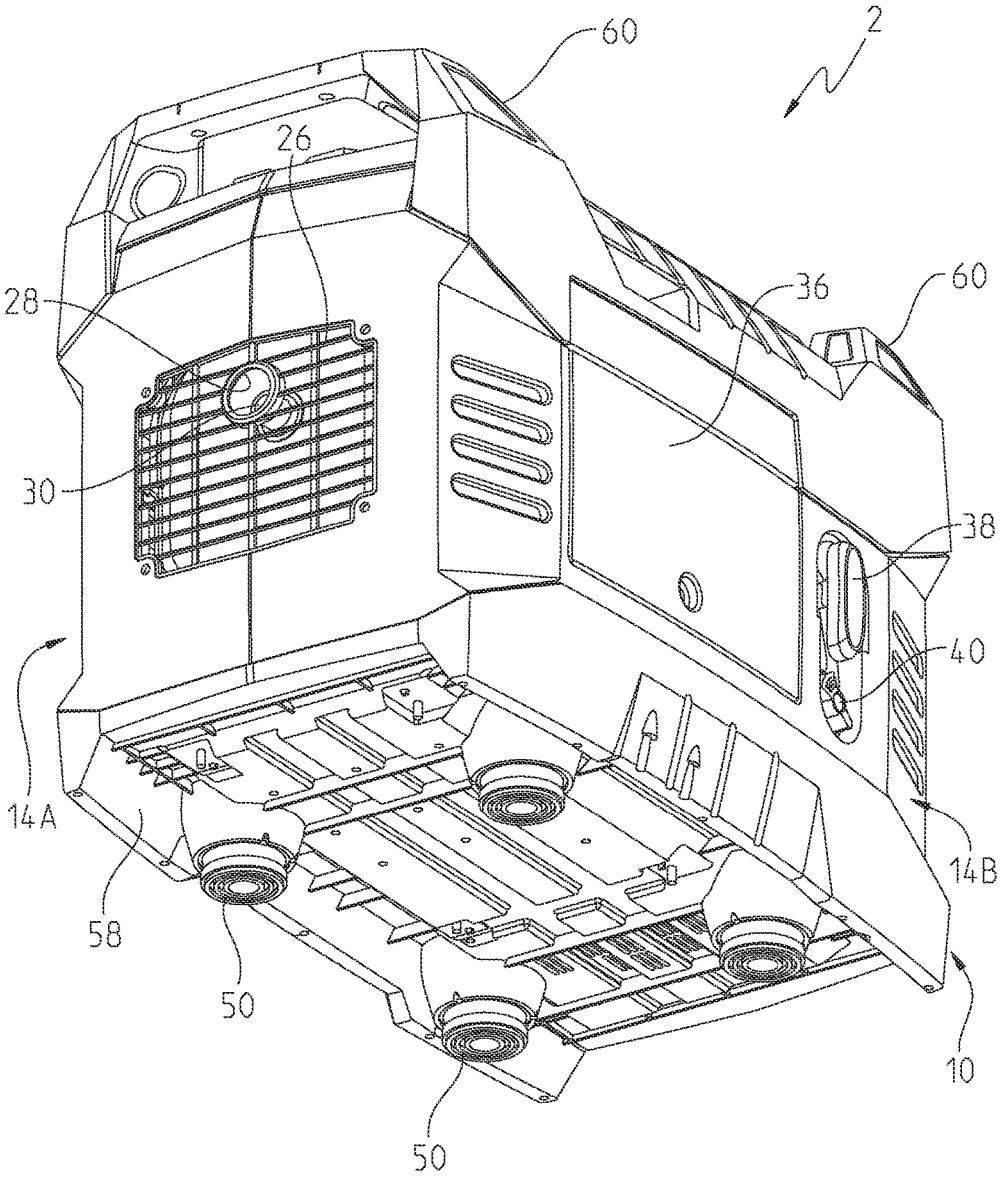
FIG. 2 is a lower rear perspective view of the portable generator of FIG. 1.
Figure 3:
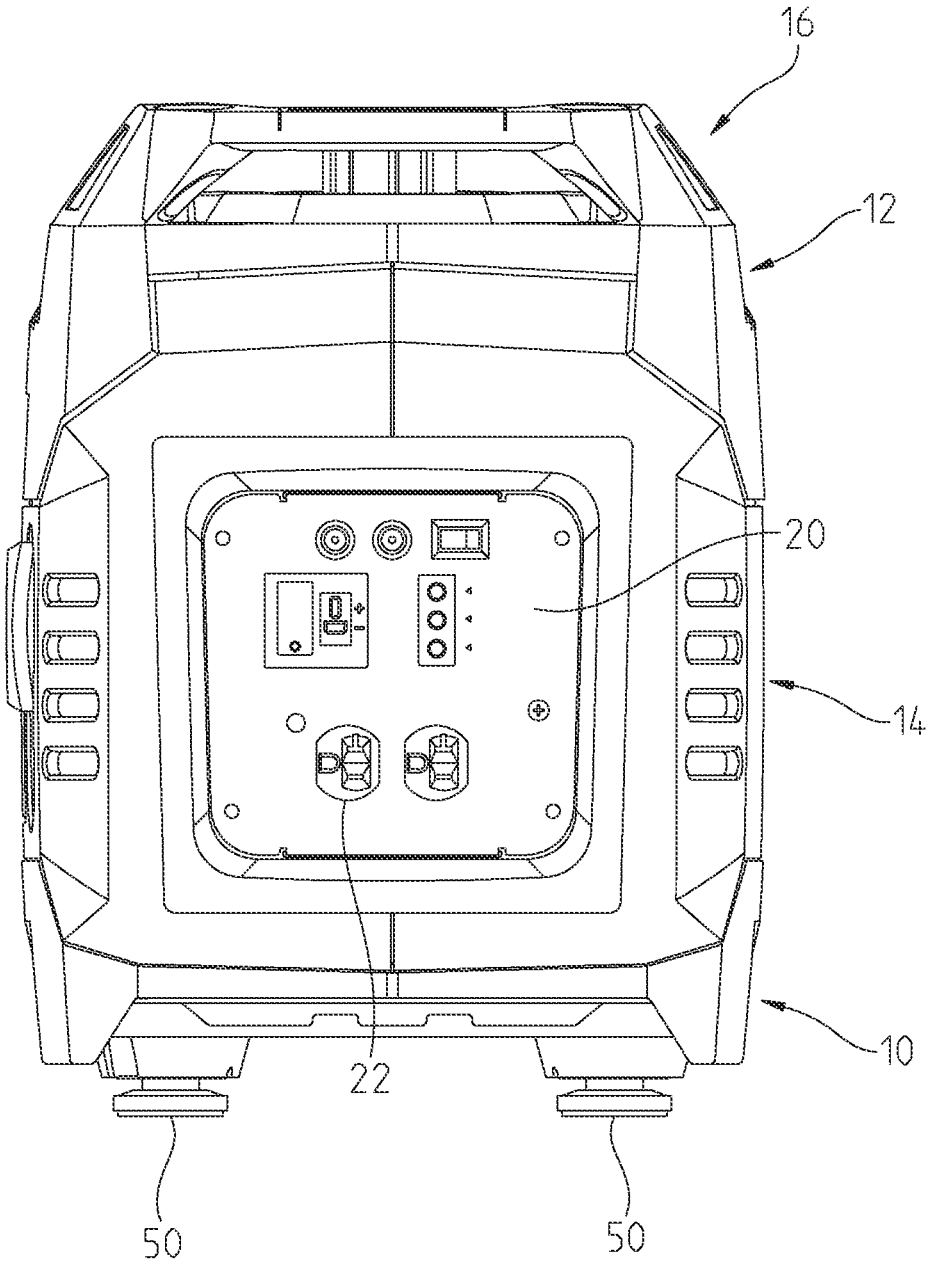
FIG. 3 is a front-end view of the portable generator of FIG. 1.
Figure 4:
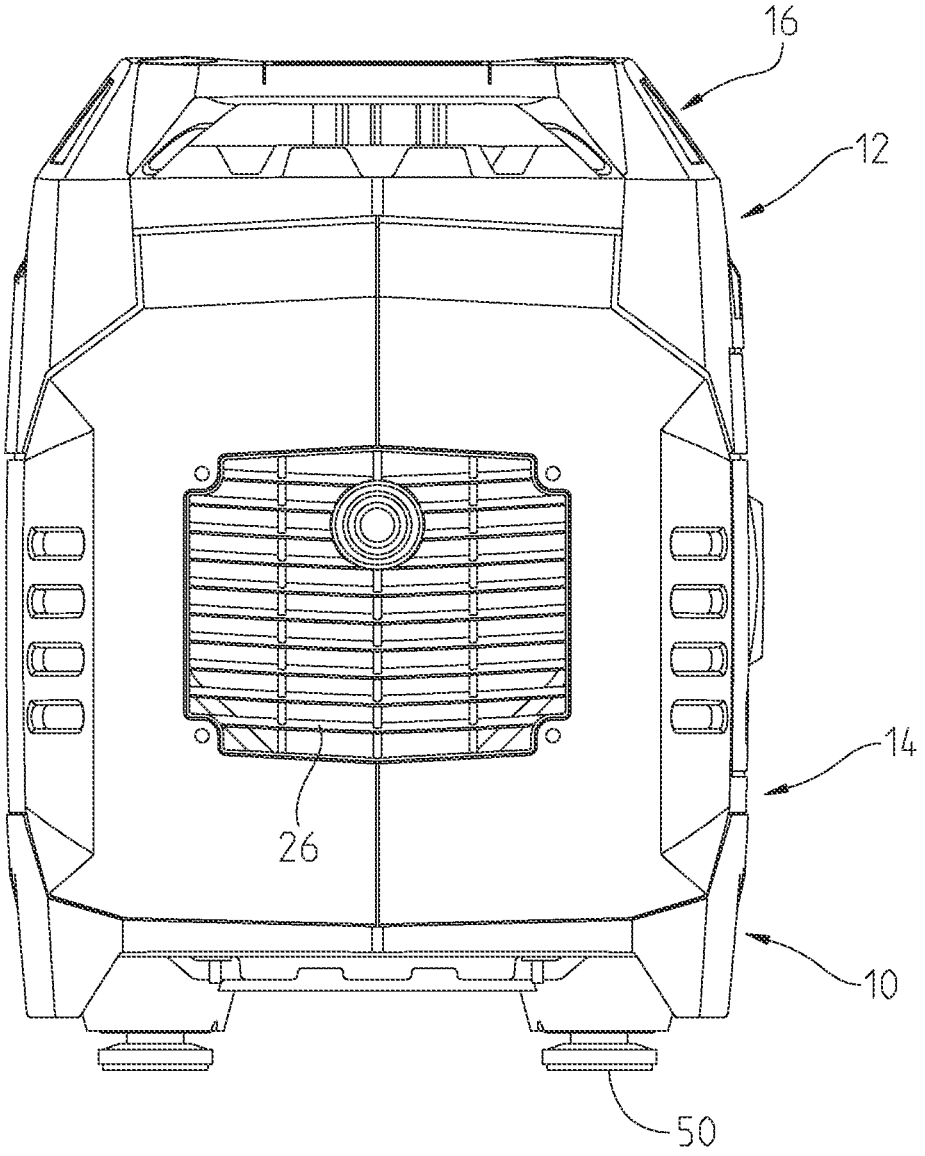
FIG. 4 is a back-end view of the portable generator of FIG. 1.

Portable generator 2 further includes power output board 20, which includes various power outlets such as a three-prong receptacle at 22. As shown in FIG. 2, the opposite end of engine-generator 2 includes an integrated grate 26, which includes an opening 28 for alignment with a muffler 30 of engine-generator 6. With reference still to FIG. 2, portable generator 2 further includes a service door 36 removable from middle housing section 14*b* to access various components of engine 6 as described herein. A pull start 38 projects through housing portion 14*b* together with engine choke 40. Feet 50 are integrated with lower housing base portion 10 for placement on a surface, or for contact with an adjacent generator; that is, in the case of stacking, where the feet 50 of one generator contact upper surfaces 52 (FIG. 7) of an adjacent generator. In that same regard, lower housing base portion 10 includes an inner contoured surface 58, which compliments outer surfaces 60 of handles 16 in order to simplify stacking the portable generators 2.

Figure 10:
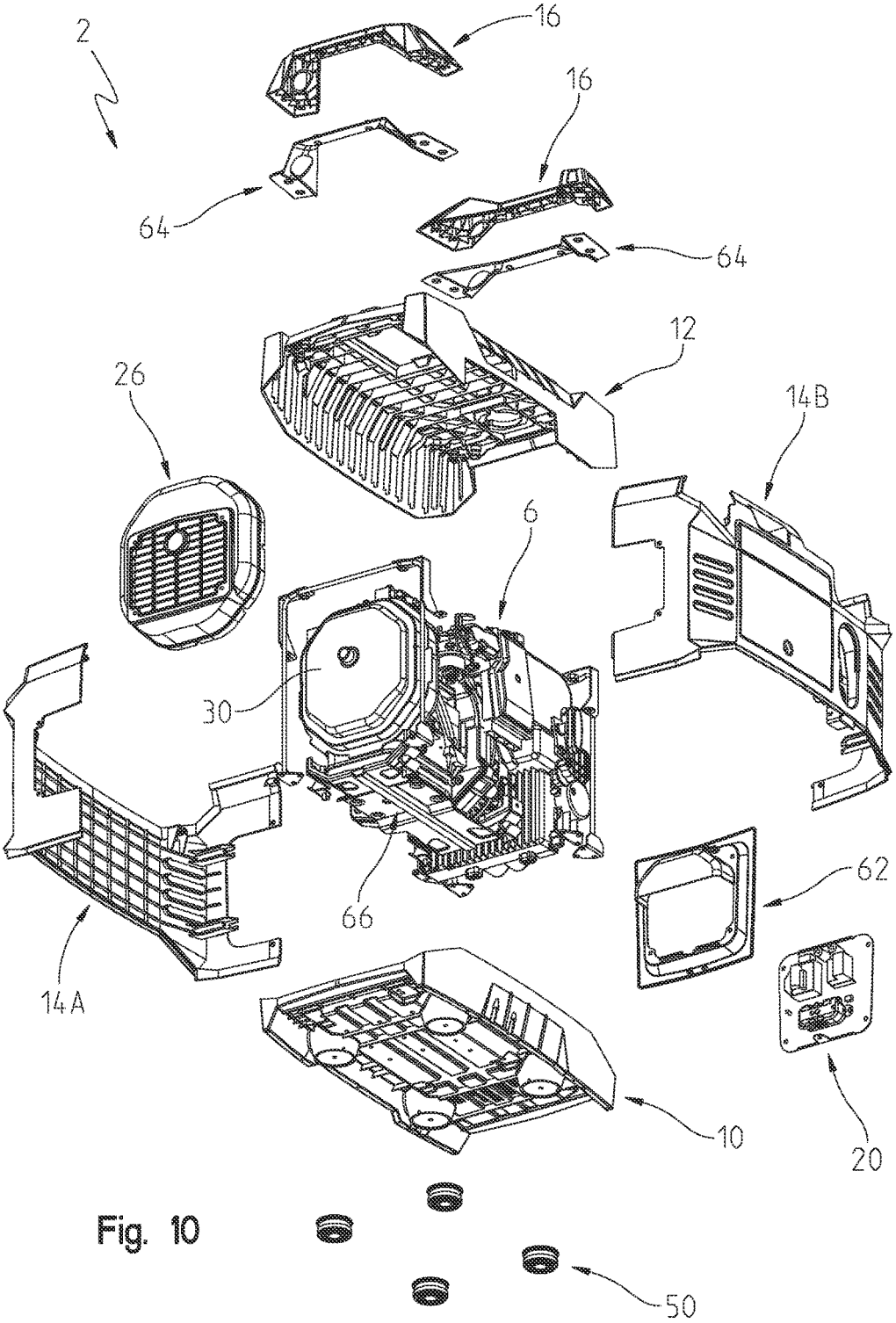
FIG. 10 is a view similar to that of FIG. 2 showing the various components in an exploded manner.
Figure 11:
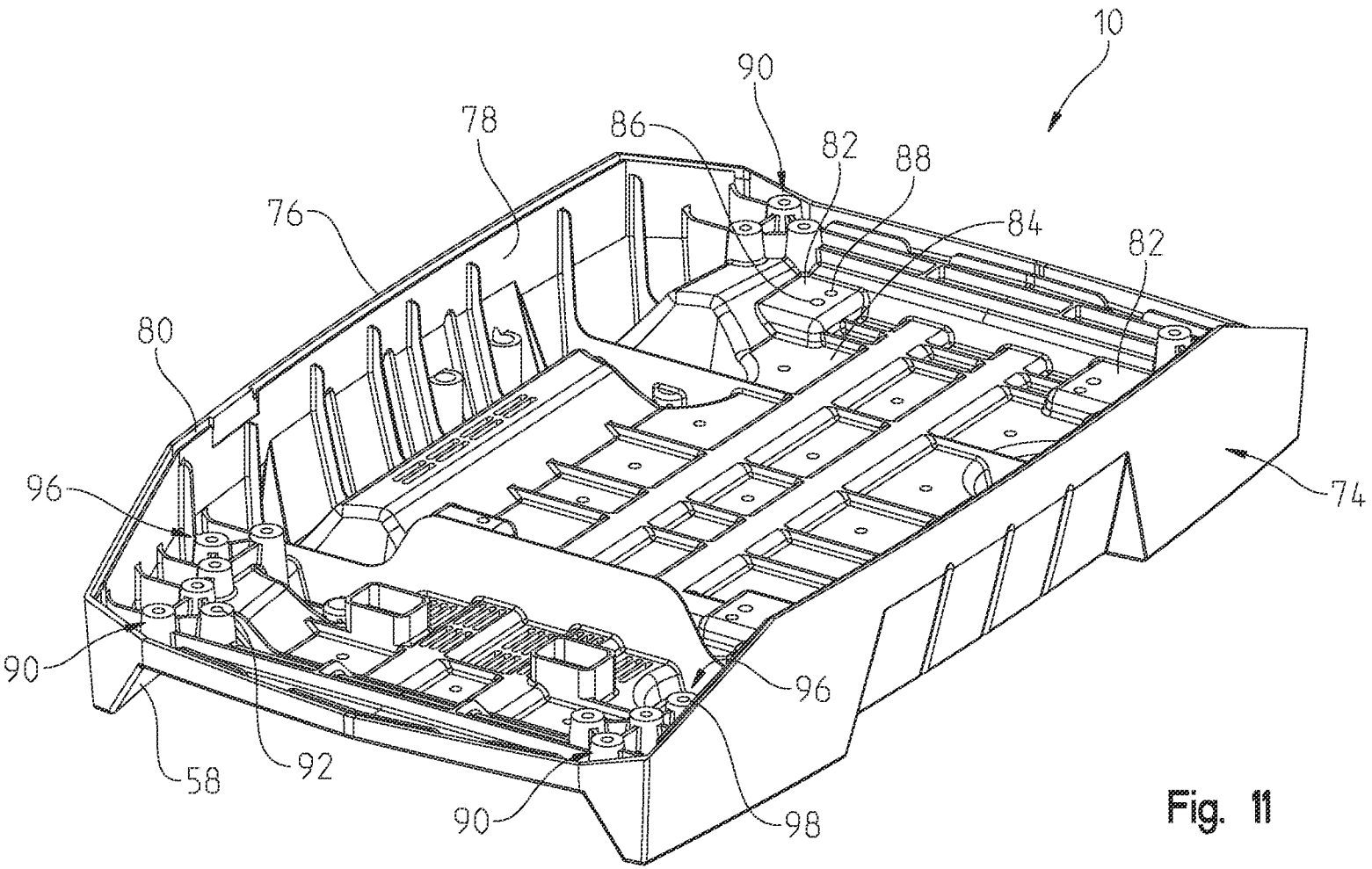
FIG. 11 is a top-perspective view of the lower housing base portion.
Figure 12:
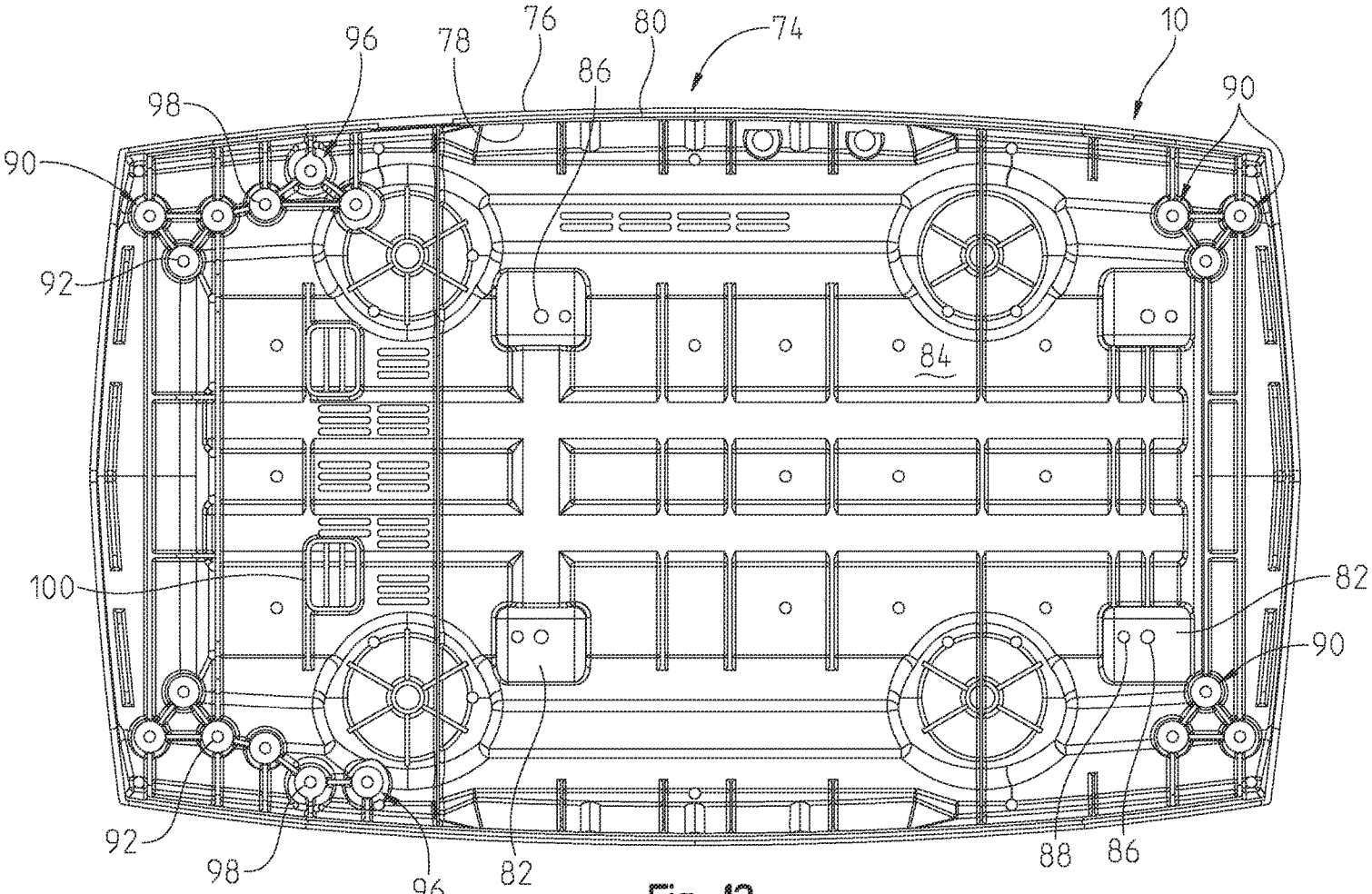
FIG. 12 is a top plan view of the lower housing base portion of FIG. 11.
Figure 13:
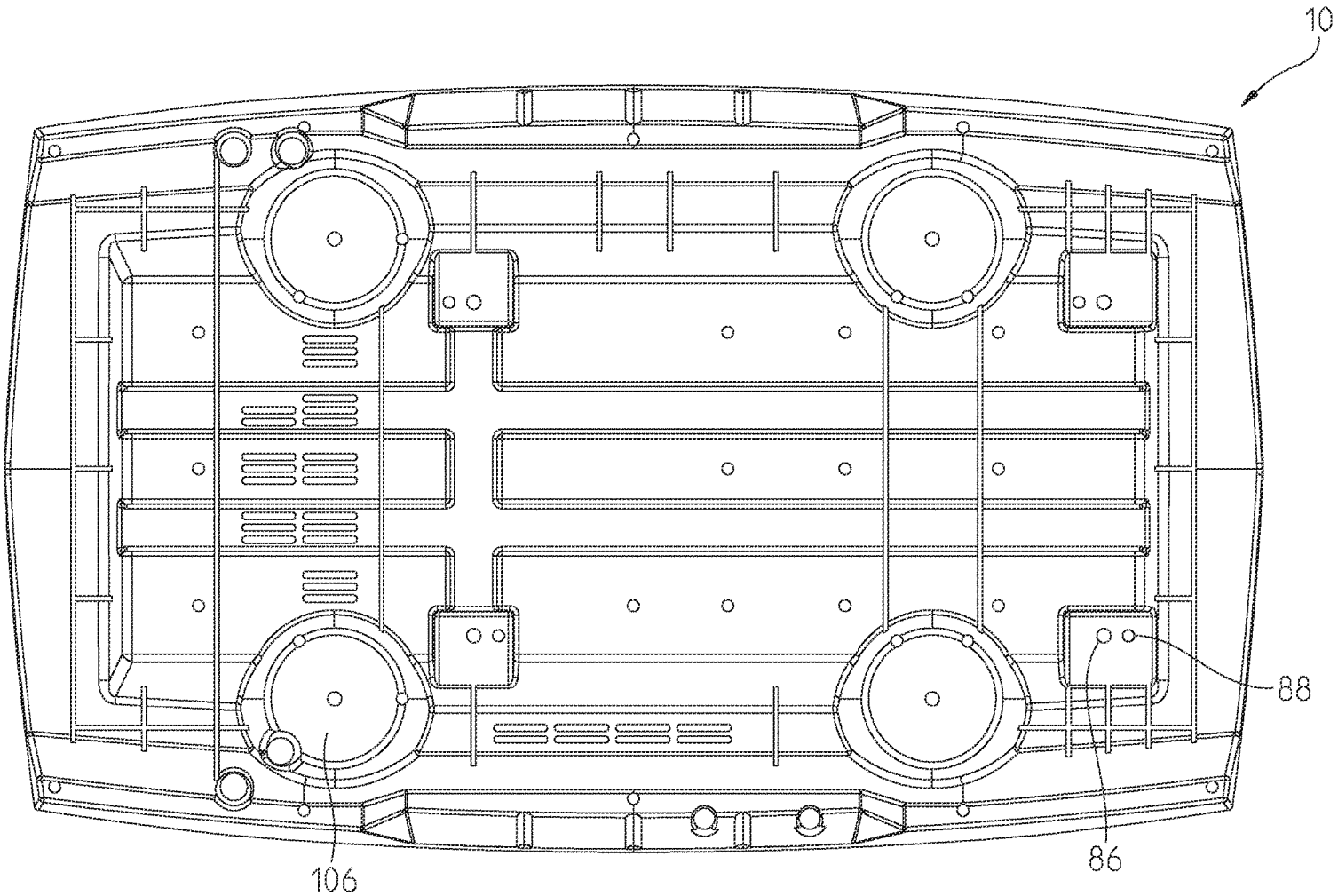
FIG. 13 is a lower view of the lower housing base portion.

With respect now to FIGS. 9 and 10, portable engine generator 2 is shown in an exploded manner and further comprises a faceplate 62, handle frames 64, and an inner frame 70. With reference now to FIGS. 11-13, lower housing base portion 10 will be described in greater detail.

As shown, lower housing base portion 10 includes sidewalls 74 defined by an outer wall portion 76, an inner wall portion 78, thereby defining a gap or groove 80 therebetween. Lower housing base portion 10 further includes mounting portions 82 defined as pedestals upstanding from a floor 84. Each pedestal includes an enlarged aperture at 86 and a reduced diameter aperture at 88 as described herein. Mounting bosses 90 also upstand from floor 84 and include apertures 92 profiled to receive a fastener therethrough as described herein. A second array of bosses 96 upstand from floor 84 and include apertures 98 as described herein. As shown in FIG. 13, lower housing base portion 10 is shown with openings 106 for receiving feet 50. It should also be appreciated that apertures 86 and 88 project entirely through the lower housing base portion to an underside thereof.

Figure 14:
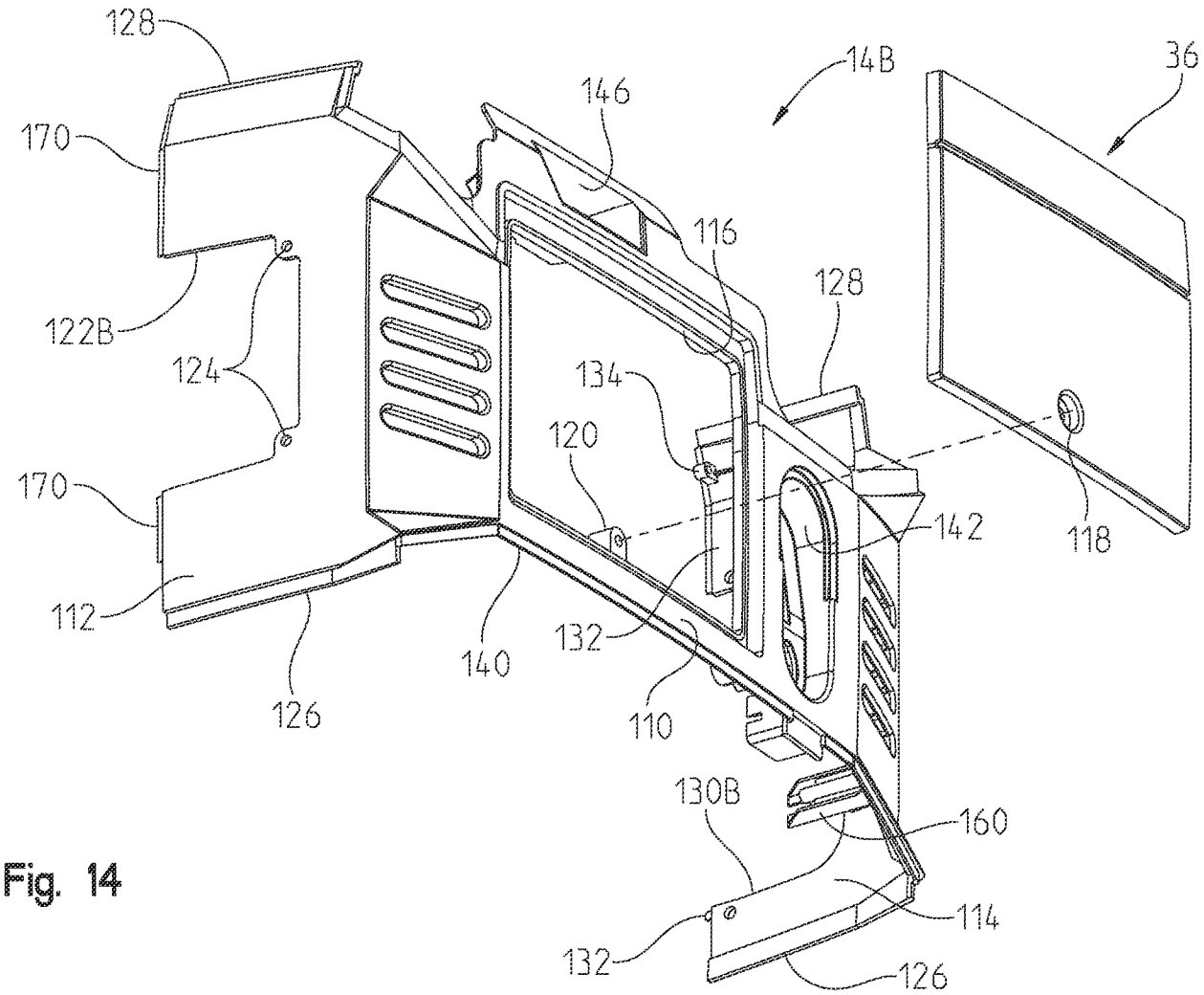
FIG. 14 is a perspective view of one-half of the housing middle portion.
Figure 15:
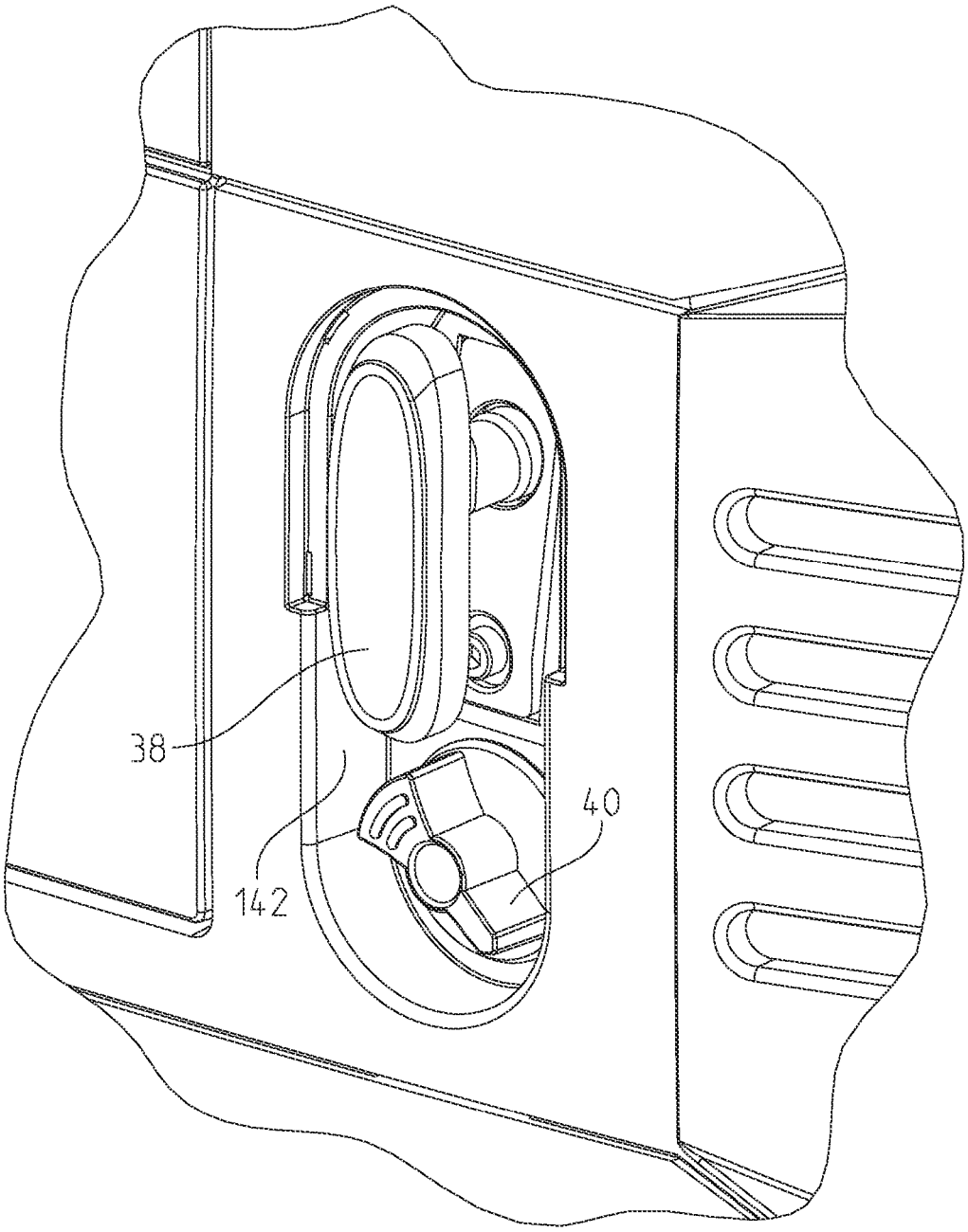
FIG. 15 shows an enlarged portion of the middle portion of FIG. 14.

With respect now to FIG. 14, middle housing section 14*b* is shown having a front wall 110, sidewall 112, and opposite sidewall 114. Front wall 110 includes an opening 116 to receive service door 36 therein, which is coupled by way of a fastener through aperture 118, which couples into boss 120. Sidewall 112 includes a cut-out portion 122*b* having apertures at 124 as described herein. A lower edge of wall 112 includes a lower lip 126 and an upper edge includes lip 128. Sidewall 114 includes an opening at 130B and has a tongue 132 at one end and a boss 134 at an upper end. Wall 114, also includes a lower lip 126 and an upper lip 128 in the same manner as wall 112. Front wall 110 includes a lower lip at 140, an oval-shaped opening at 142 (see also FIG. 15) for the receipt of pull cord 38 and choke 40. Finally, wall 110 includes a generally rectangular-shaped opening at 146 for accessing a throttle as described herein.

Figure 16:
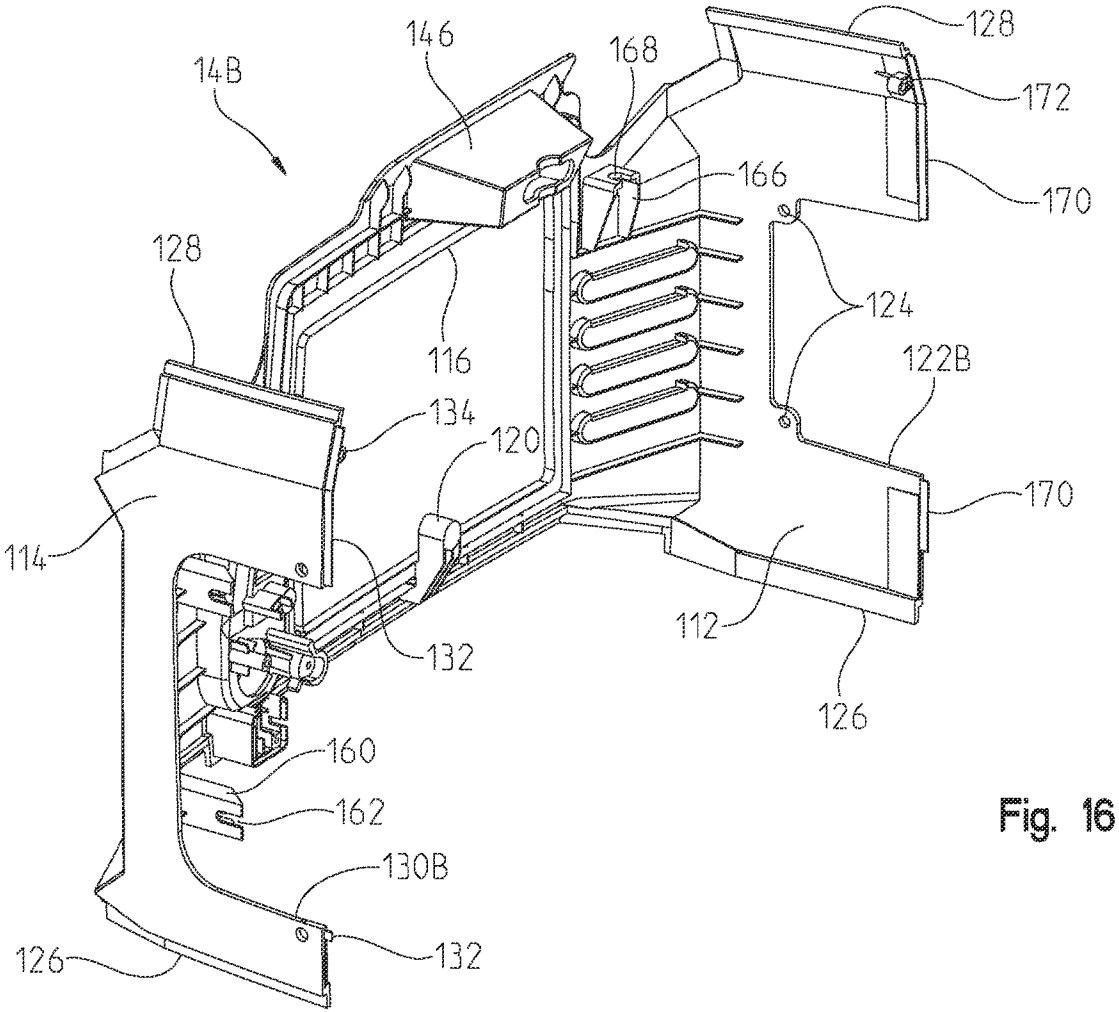
FIG. 16 is an inside perspective view of the housing portion of FIG. 14.

As shown in FIG. 16, middle housing section 14*b* further includes pedestals 160 having a slotted opening 162 and pedestals 166 having a slotted opening at 168. Sidewall 112 further includes side lip 170 and boss 172.

Figure 17:
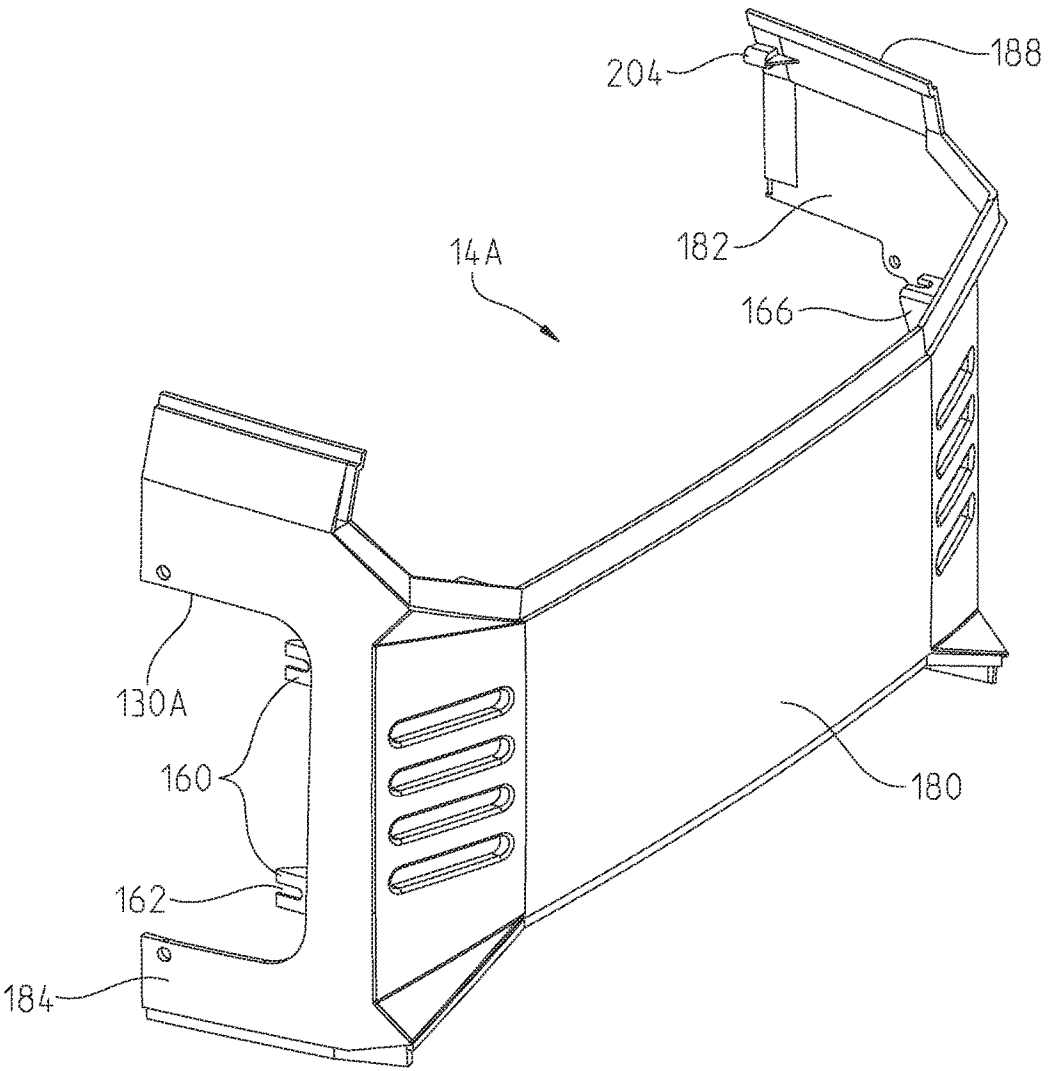
FIG. 17 is an enlarged perspective of the opposite housing half, which cooperates with the housing half of FIGS. 14-16.
Figure 18:
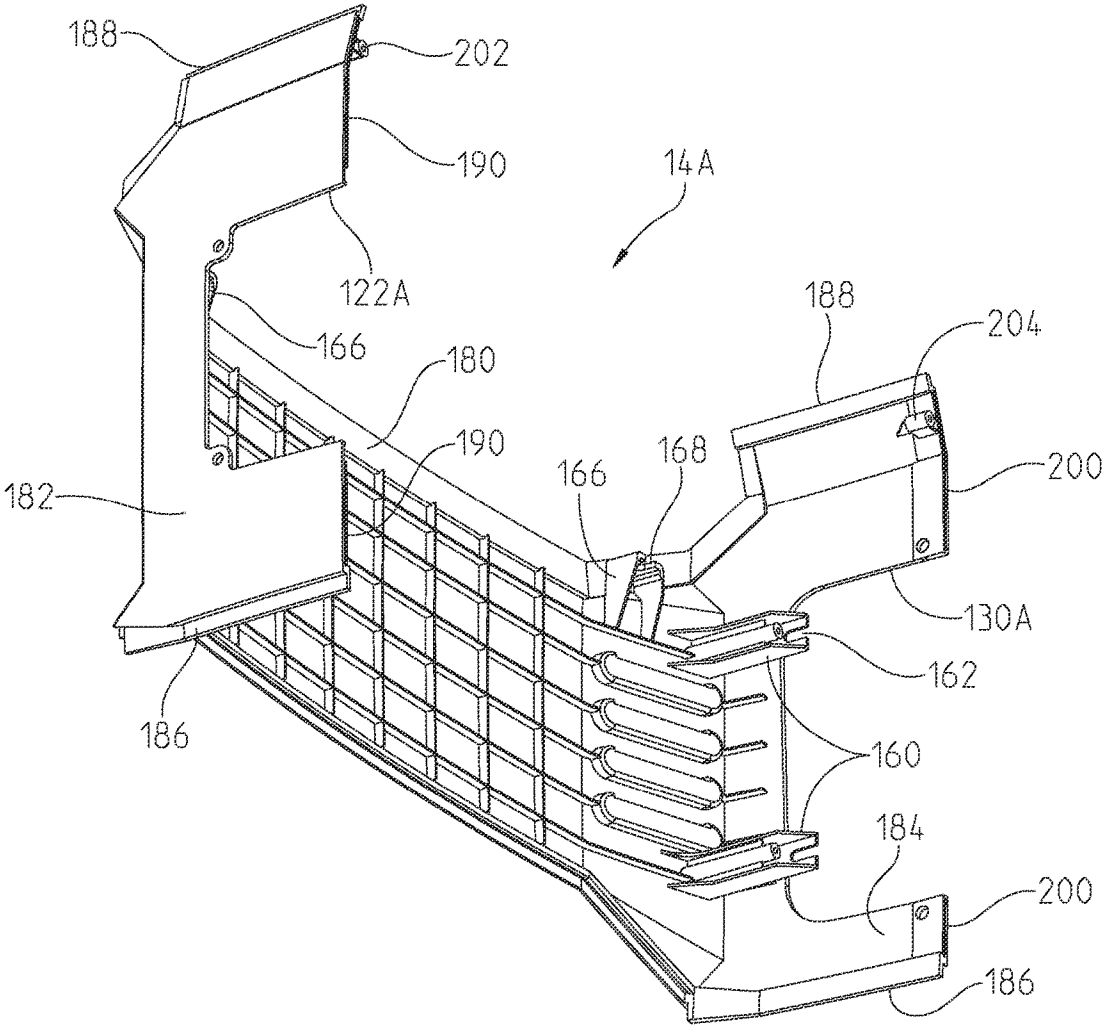
FIG. 18 is an inside perspective view of the housing half of FIG. 17.

As shown best in FIGS. 17 and 18, middle housing section 14*a* is shown including front wall 180, sidewall 182, and sidewall 184. Sidewall 182 includes a lower lip 186 and an upper lip at 188 (FIG. 18). Sidewall 182 further includes a slot or groove 190, which is profiled to receive side lips 170 (FIG. 14). As shown in FIGS. 17 and 18, middle housing section 14*a* includes additional pedestals 160 with slotted apertures 162 and pedestals 166 having slotted apertures at 168. As shown best in FIG. 18, sidewall 184 includes a side groove 200 profiled to overlap side lip 132 of section 14*b*. Housing section 14*a* further includes a boss 202 profiled to cooperate with boss 172 on section 14*b* and includes a boss 204 profiled to correspond with boss 134 on section 14*b*.

It should be appreciated that the housing sections 14*a* and 14*b* couple together to define middle section 14. That is, lips 170, 132 are receivable in grooves 190, 200 respectively. This positions bosses 172, 202 and 134, 204 adjacent to each other, respectively. A fastener may now be positioned into bosses 134, 172 and threaded into bosses 204, 202 respectively, retaining the halves 14*a*, 14*b* together.

Figure 19:
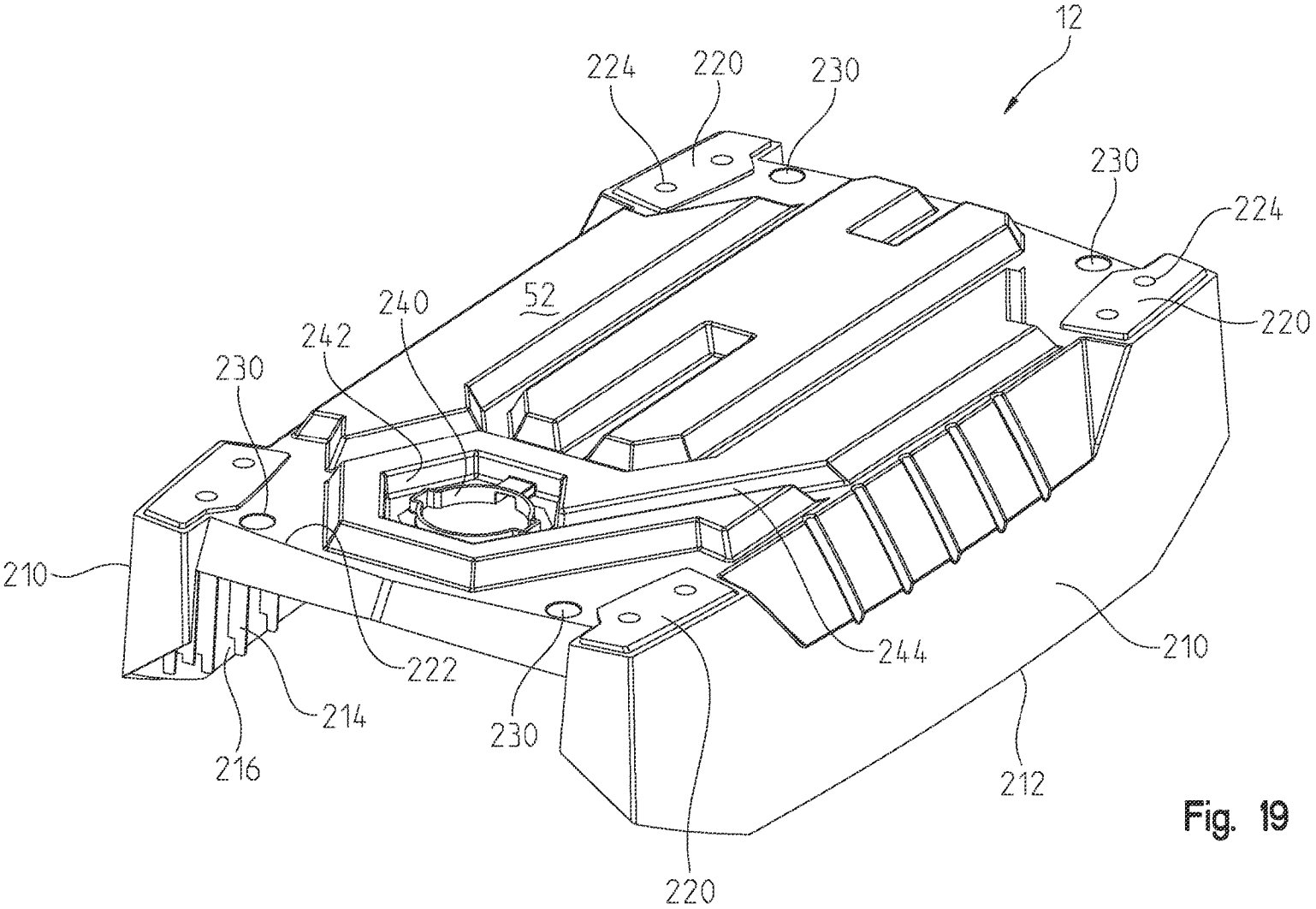
FIG. 19 is a top perspective view of the upper cover of the housing.
Figure 20:
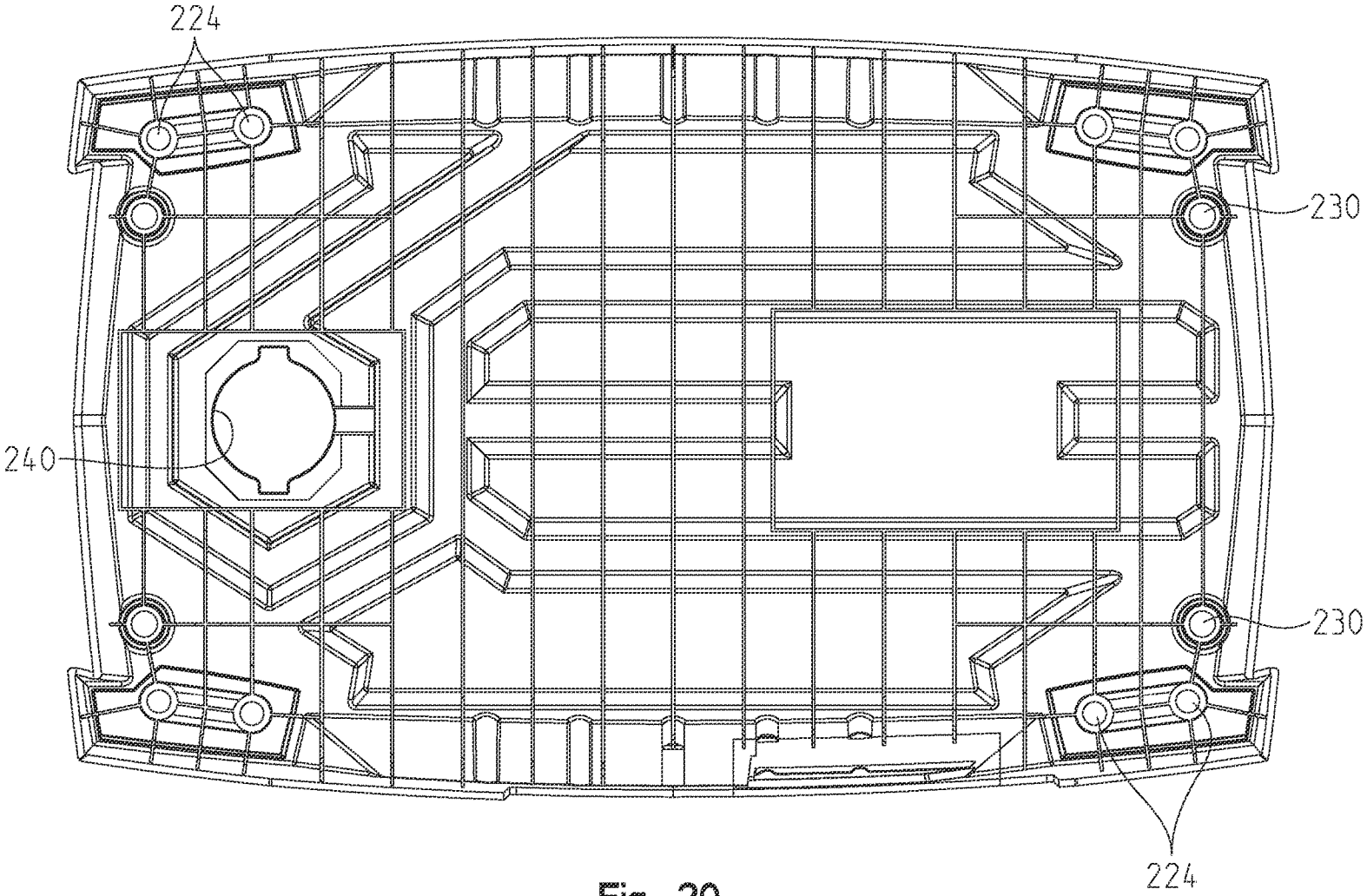
FIG. 20 is an inner view of the cover of FIG. 19.

With reference now to FIGS. 19 and 20, upper cover portion 12 will be described in greater detail. As shown, upper cover portion 12 includes sidewalls 210 depending from top wall 52 where sidewalls include a lower marginal edge at 212, strengthening ribs 214, having gaps 216 thereby defining a groove for receipt of upper lips 188. Upper cover portion 12 further includes pedestals 220 projecting from a recessed surface 222 and having apertures 224 extending therethrough. Apertures 224 extend entirely through upper cover 12 as shown best in FIG. 20. Upper cover portion 12 further includes two apertures 230 at each end of top wall 52, which also project entirely through the upper cover portion 12 as best shown in FIG. 20. Upper cover portion 12 also includes an opening 240 to receive a portion of a fuel tank therethrough as described herein. Opening 240 is surrounded by a recess 242, which communicates with a trough 244, which allows for the drainage of excess fuel to be drained away from opening 240.

Figure 21:
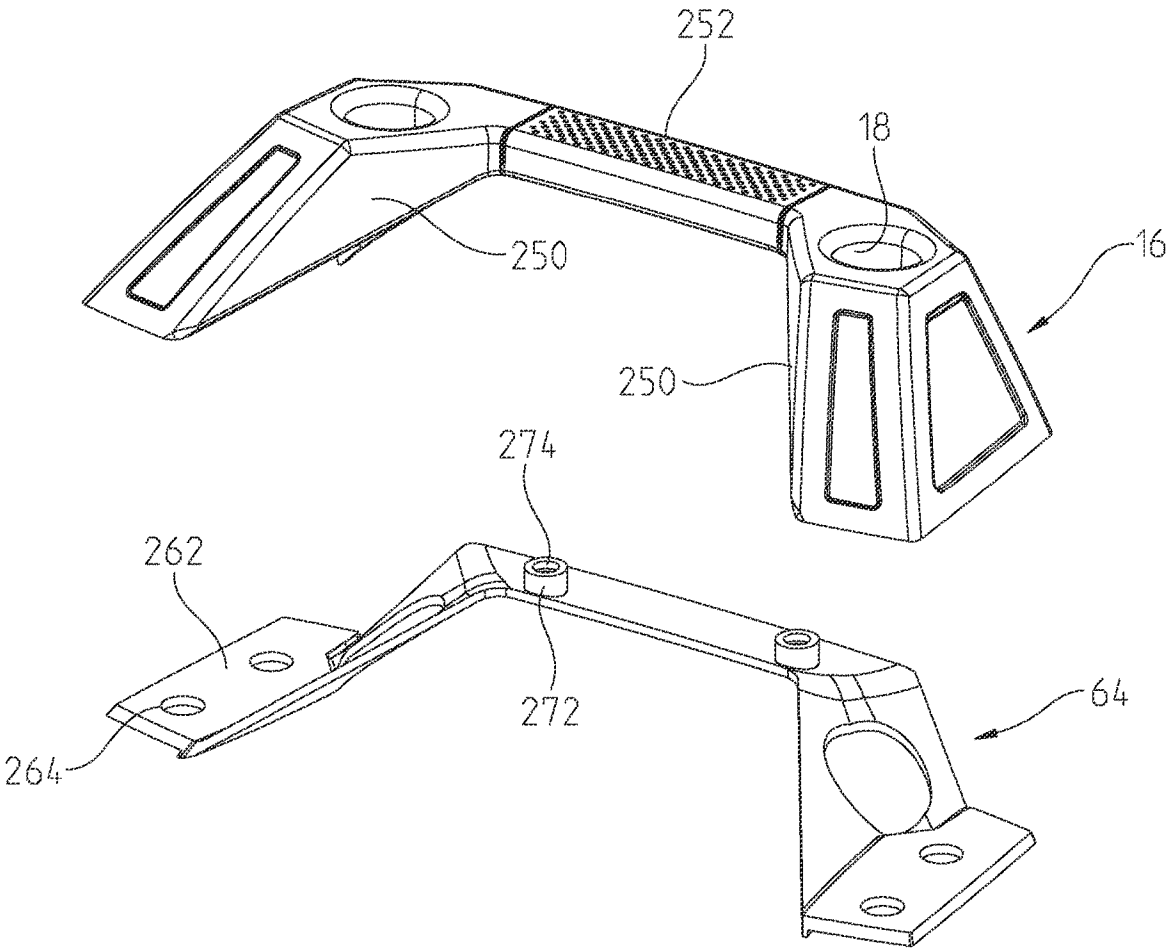
FIG. 21 is an upper perspective view of a handle and handle frame member.
Figure 22:
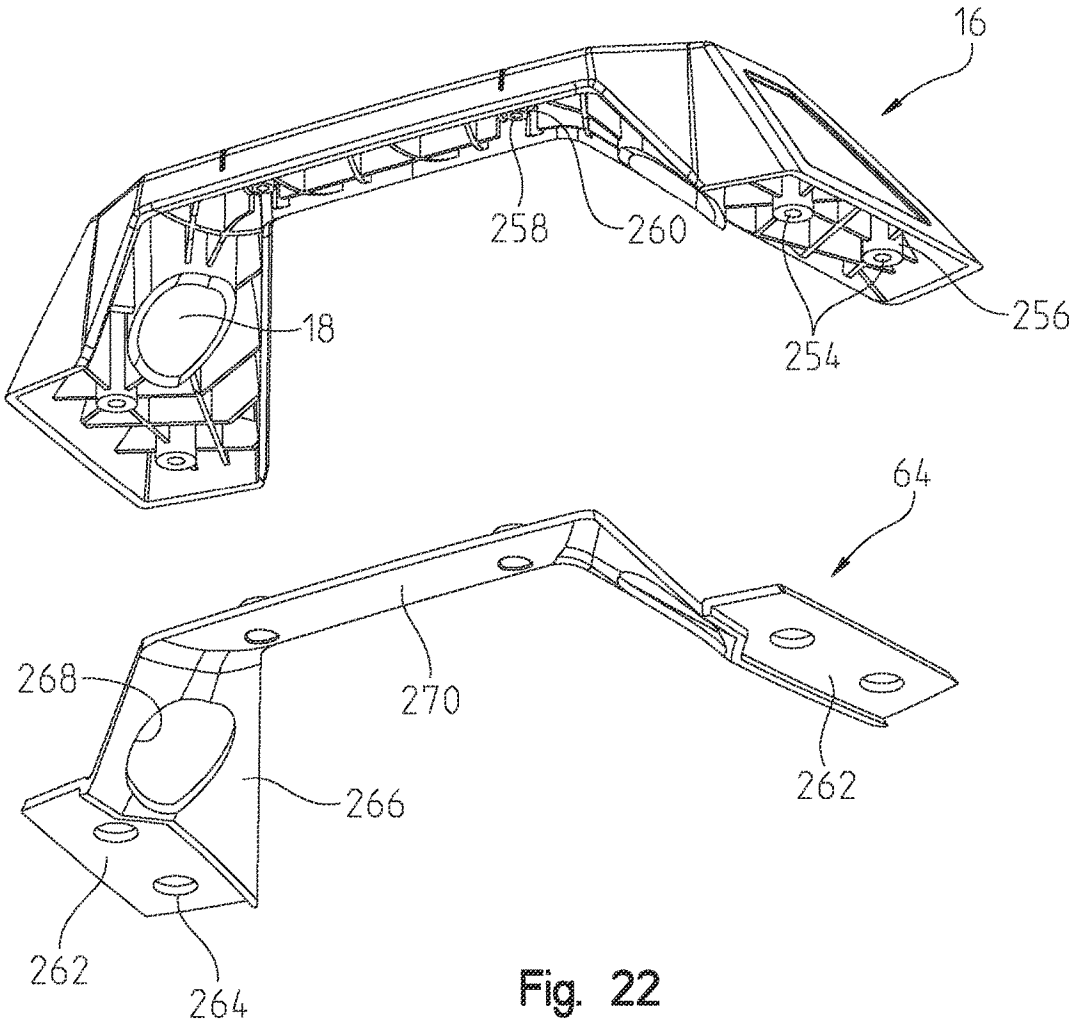
FIG. 22 is an underside perspective view of the components shown in FIG. 21.

As shown in FIGS. 21 and 22, handle 16 and handle frame 64 are described in greater detail. As shown, handle 16 includes feet portions 250 with a grip handle 252 extending therebetween. As shown in FIG. 22, feet 250 include apertures 254 positioned in bosses 256, and apertures 258 positioned in bosses 260. As shown, handle frame 64 includes flanges 262 having apertures 264. Upright portions 266 extend upwardly from flanges 262 and include opening 268, which overly opening 18. Transverse portion 270 connects the upright portions 266 and includes bosses 272 (FIG. 21) for the assembly of the handle 16 and handle frame 64 as described herein.

Figure 23:
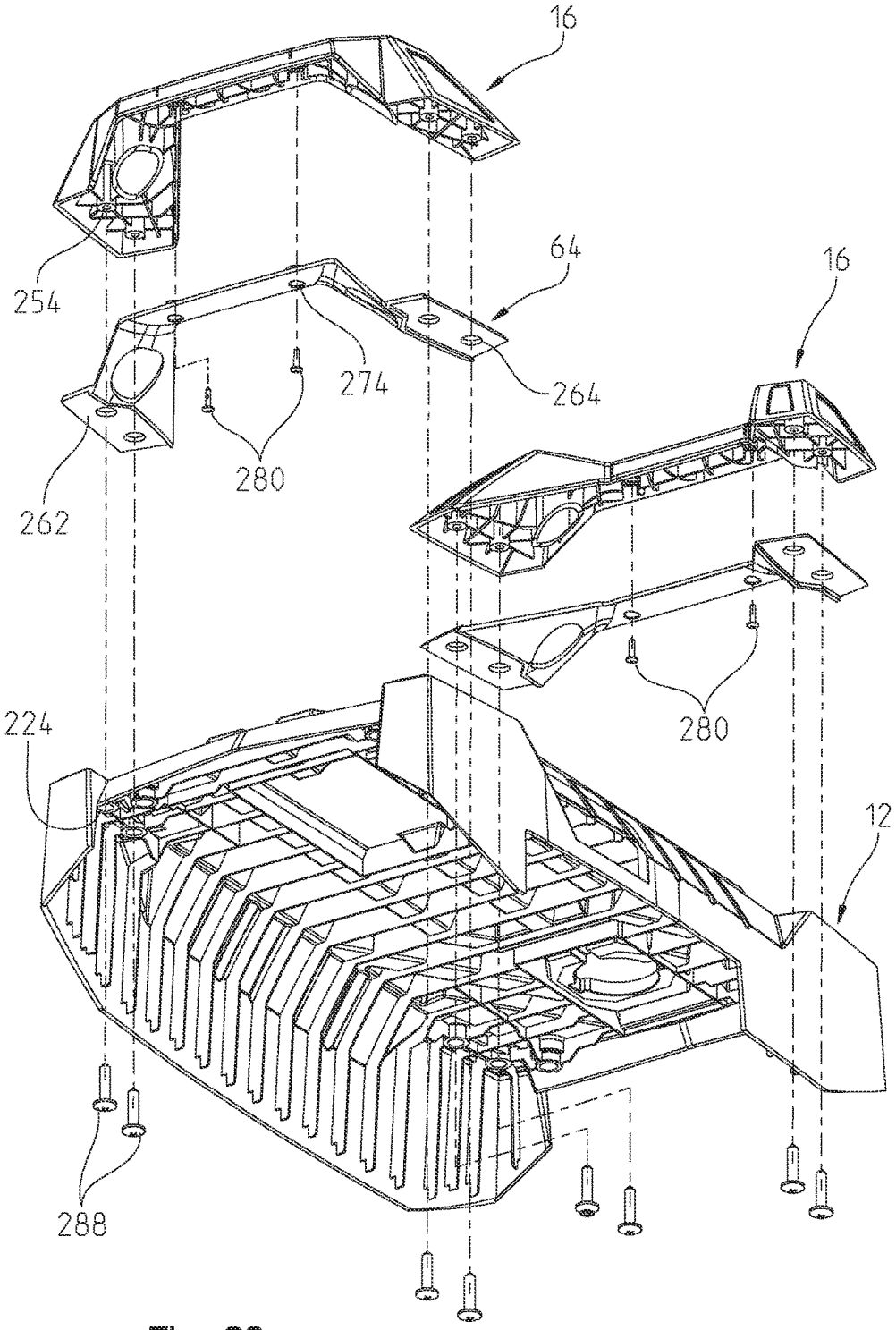
FIG. 23 is an underside perspective view of the handle, handle frame, and upper cover.

With reference now to FIG. 23, the handles 16, handle frame 64, and upper cover portion 12 may be preassembled as described herein. As shown, handle frames 64 are first preassembled to each of the handles 16. This is accomplished by providing fasteners 280 through apertures 274 where fasteners are threadably received in apertures 258 (FIG. 22) of bosses 260. This retains the handle frames 64 to the handles 16. A combination of the handles 16 and handle frame 64 is thereafter positioned with flanges 262 on pedestals 220 (FIG. 19). Each of the handles is aligned with the apertures 254, 264 in alignment with apertures 224. Fasteners 288 are thereafter received from a lower side of upper cover portion 12 through apertures 224 to be received in apertures 254. This retains handles 16, handle frames 64, and upper cover portion 12 together.

Figure 24:
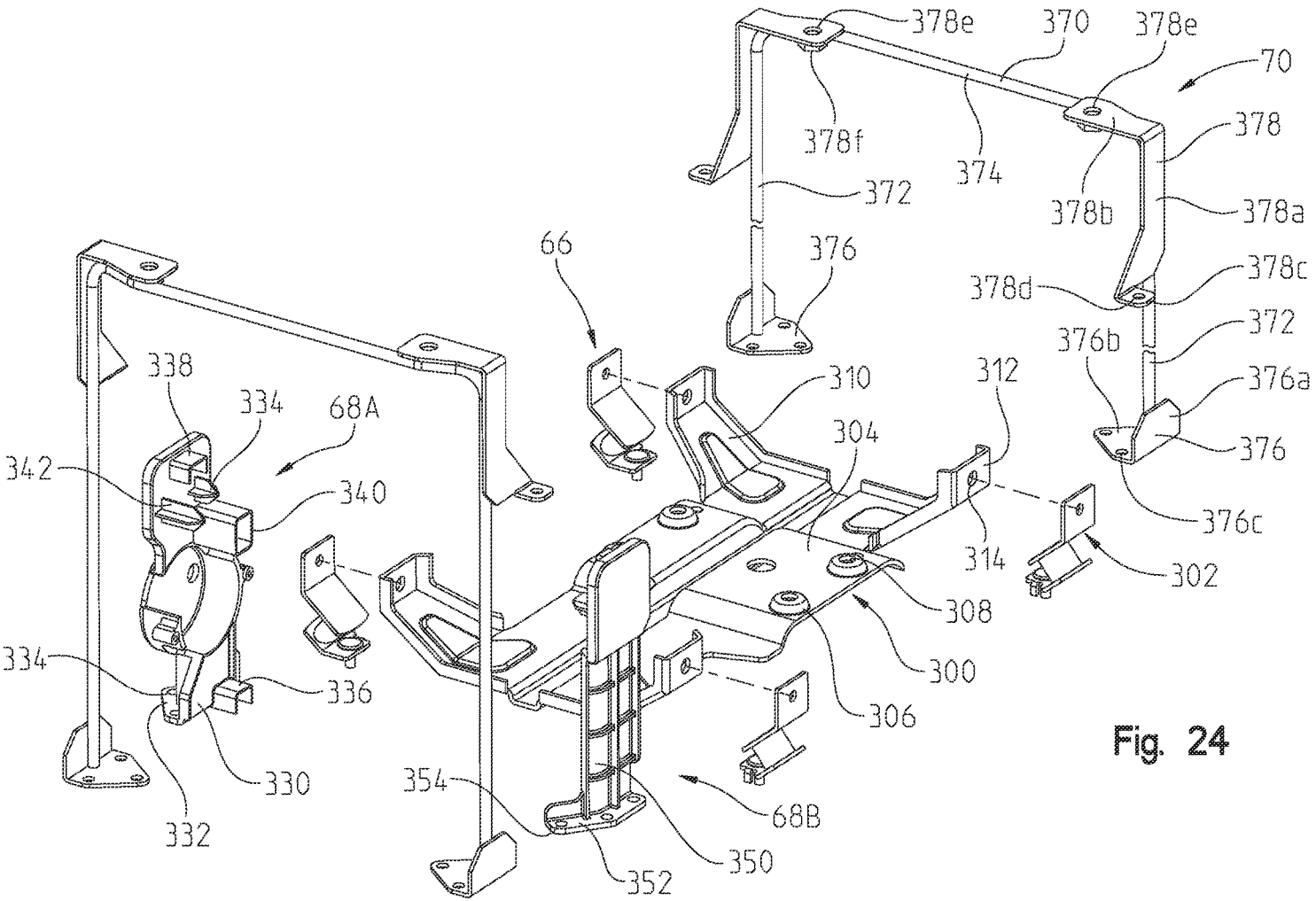
FIG. 24 shows a perspective view of the inner frame, fuel tank mount and engine mount.

With reference now to FIG. 24, the engine mount 66, fuel tank mount 68, and housing frame 70 will be described in greater detail. As shown, engine mount 66 includes a mounting plate 300 and isolation mount 302. Mounting plate 300 includes a central plate portion 304 having upstanding bosses 306 with apertures 308. Mounting plate 300 further includes mounting arms 310 having plate portions 312 with a mounting aperture at 314. As shown, the mounting plates 312 exist in vertical planes as described herein.

Figure 25:
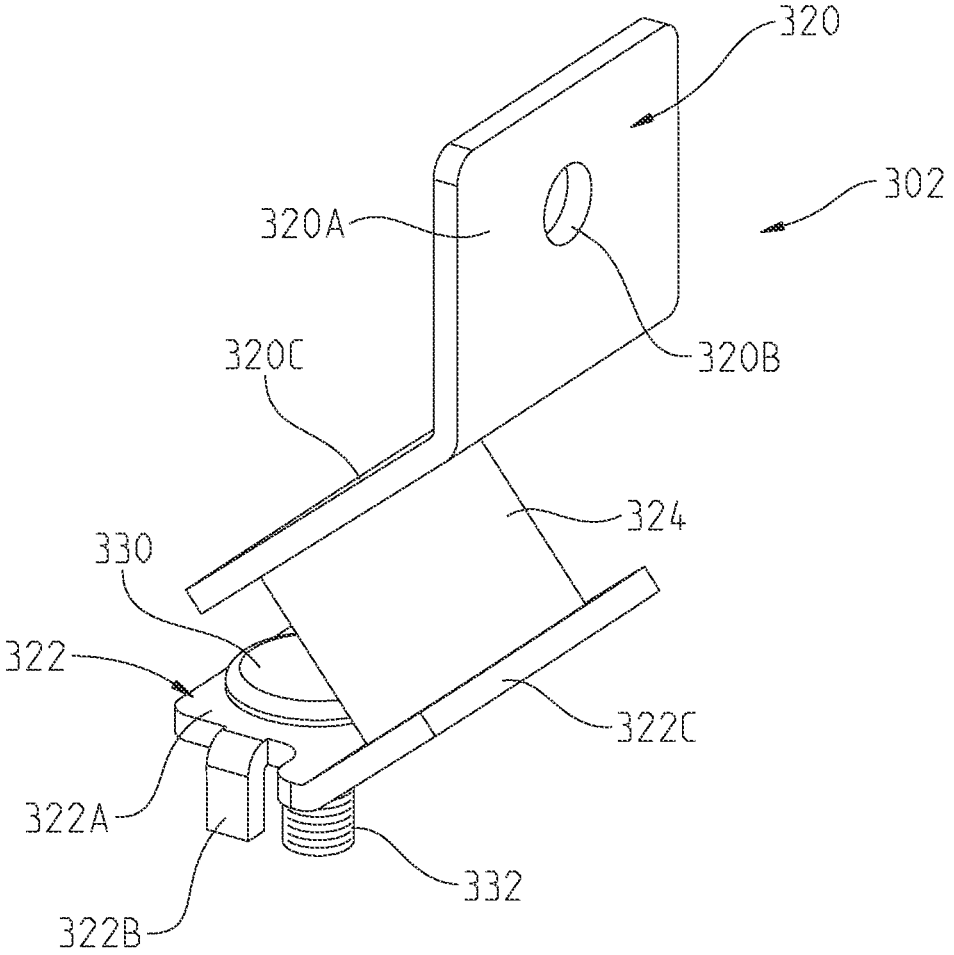
FIG. 25 shows an enlarged perspective view of the isolation mount shown in FIG. 24.

As best shown in FIG. 25, isolation mount 302 includes two brackets, namely, an upper bracket 320 and a lower bracket 322; with an isolation member 324 positioned therebetween. Bracket 320 generally includes a bracket portion 320*a* having an aperture 320*b* extending therethrough. Bracket 320 further includes bracket portion 320*c* extending at an angle of approximately 45° relative to horizontal. Bracket 322 generally includes a bracket portion 322*a* having an alignment tab 322*b* projecting from a side edge of the bracket portion 322*a* and projecting downwardly as described herein. Bracket 322 further includes a plate portion 322*c* extending generally parallel to plate portion 322*c* where isolation member 324 is coupled between the two plate portions 320*c* and 322*c*. Isolation mount 302 further includes a stud 330 having a threaded portion 332 extending downwardly through plate portion 322*a* as described herein. In should also be appreciated that plate portions 322*a* generally extend through a horizontal plane or through a plane generally transverse to a plane through plate portion 320*a*. Isolation mount 302 is coupled to mounting plate 300 by a way of a fastener (not shown) extending through apertures 302 and 314.

As isolation member extends between the plate portions 320*c* and 322*c*, it also extends at an angle of approximately 45° relative to horizontal. This allows better isolation of vertical and lateral components of engine vibration to be dissipated, rather than transferring the vibration to the lower housing base portion 10.

Fuel tank mount 68 is generally comprised of two mount portions 68*a* and 68*b*. Mount portion 68*a* (FIGS. 24 and 26) includes an upstanding wall portion 330 coupled to a lower bracket at 332 having apertures at 334. Alignment portions 336, 338, and 340 project from a backside of plate portion 330. Alignment pegs 342 and 344 are cruciform in configuration, and extend from a backside of plate portion 330. Fuel tank mount portion 68*b* is similar to that of 68*a* including an upstanding wall 350 having bracket 352 with apertures 354. Alignment member 356 (FIG. 26) extends from a backside of wall 350 and also includes cruciform-shaped alignment members 358.

With reference again to FIG. 24, frame 70 will be described in greater detail. It should be understood that each of the frames 70 are a mirror image of the other frame and therefore only one such frame will be described. As shown, frame 70 is generally vertically upstanding having a generally inverted U-shape. The U-shape is defined by an inverted U-shaped rod 370 having vertical rod portions 372 and a transverse rod portion 374. Lower brackets 376 are coupled to lower ends of the vertical rod portions 372 and upper brackets 378 are coupled to both rod portions 372, 374. Brackets 376 include a back plate portion 376*a* and a lower bracket portion 376*b* having apertures 376*c*. Bracket 378 includes a bracket portion 378*a* coupled to rod portion 372 and a portion 378*b* coupled to rod portion 374. Plate portion 378*a* includes a tab 378*c* having an aperture at 378*d*. Bracket portion 378*b* includes an aperture 378*e* aligned with a threaded fastener 378*f*.

Figure 26:
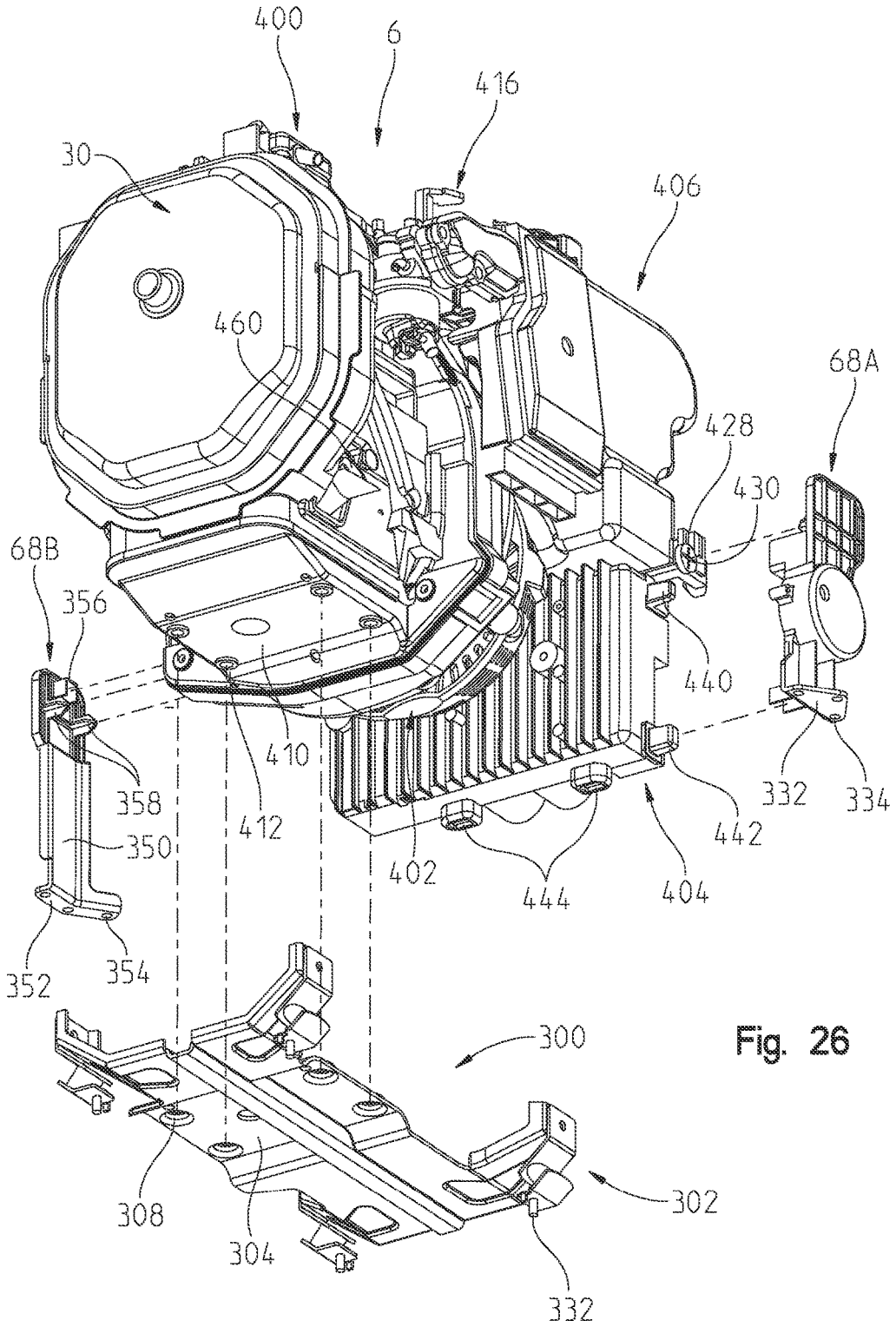
FIG. 26 shows the engine mount poised for receipt to a bottom of the engine-generator set.
Figure 29:
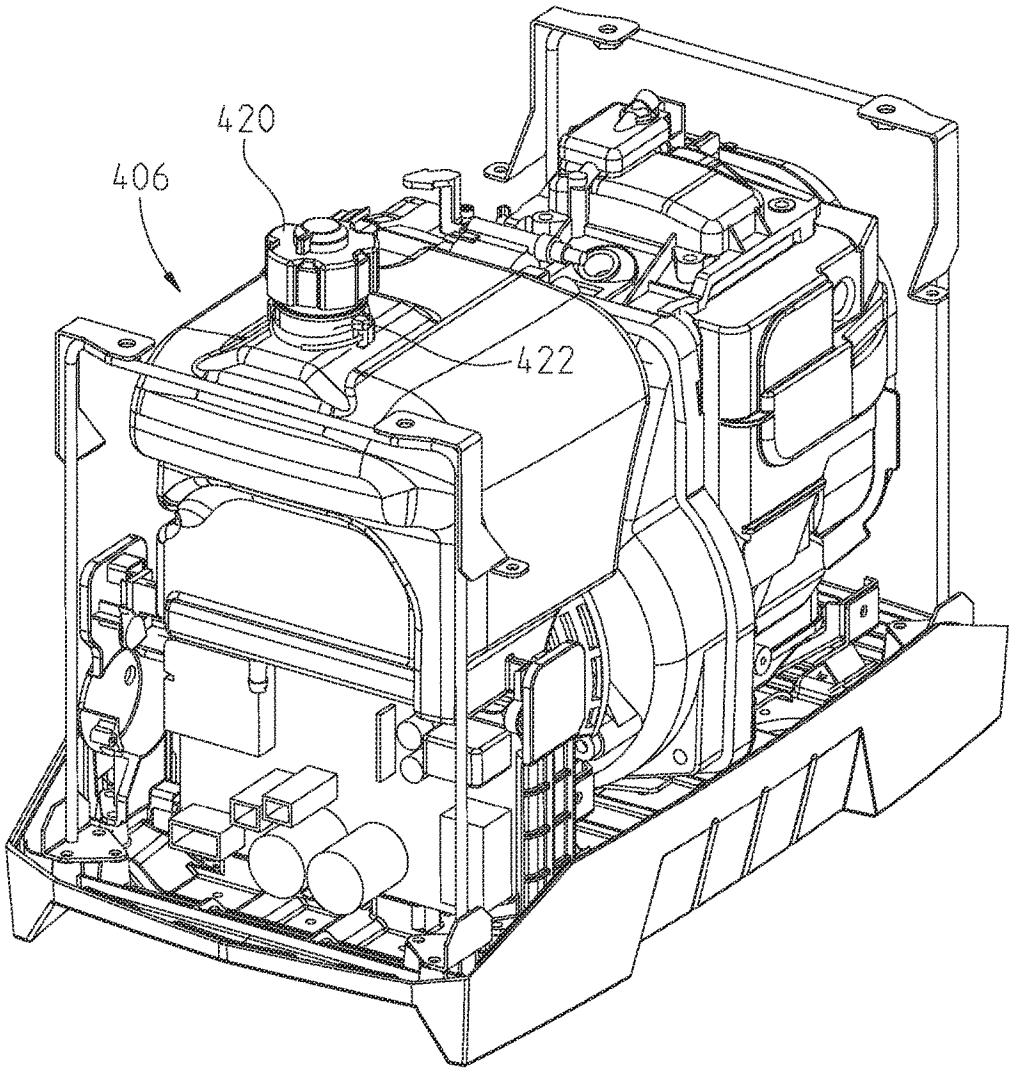
FIG. 29 shows the frame and engine-generator set positioned in the lower housing base portion.

With reference now to FIG. 26, engine-generator 6 is shown having an engine 400, generator 402, controller 404, and fuel tank 406. Engine 400 includes a lower mounting surface 410 having mounting apertures 412. Engine 400 further includes a throttle at 416. Fuel tank 406 includes a fuel cap 420 and a filler neck 422 (FIG. 29). Fuel tank 406 further includes alignment studs 428 having a cruciform opening at 430. Controller 404 includes alignment tabs 440, 442, and 444. As shown in FIG. 26, engine mounting plate 300 may be coupled to surface 410 of engine 400 by way of fasteners through apertures 308 and 412.

Thus, engine-generator 6 may be coupled to lower housing base portion 10 by positioning threaded fasteners 332 of studs 330 (FIG. 25) through apertures 86 (FIG. 12) and with tabs 322*b* (FIG. 25) positioned through apertures 88 (FIG. 12). Threaded stud 332 will protrude through apertures 86 and a threaded fastener may be attached to the underside of lower housing base portion 10. At the same time, mounts 68*a* and 68*b* may be positioned with their respective flanges 332, 352, positioned over bosses 96 (FIG. 12) with fasteners received through apertures 334, 354 retaining fuel tank 406 and controller 404 to the lower housing base portion 10. At the same time, projections 444 (FIG. 26) are positioned into apertures 100 (FIG. 27) of lower housing base portion 10.

Figure 27:
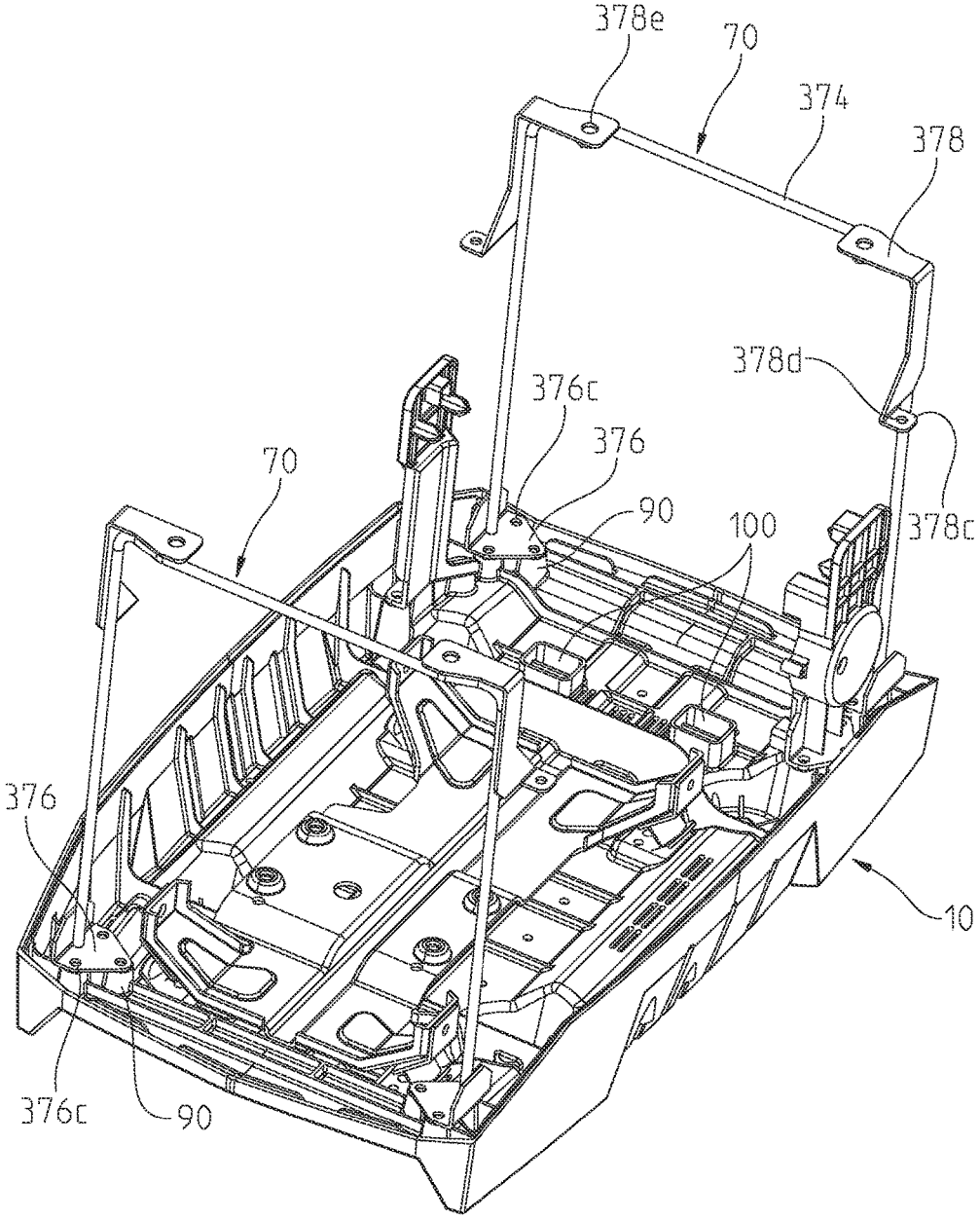
FIG. 27 shows the frame, fuel tank mount and engine mount positioned in the lower housing base portion.
Figure 28:
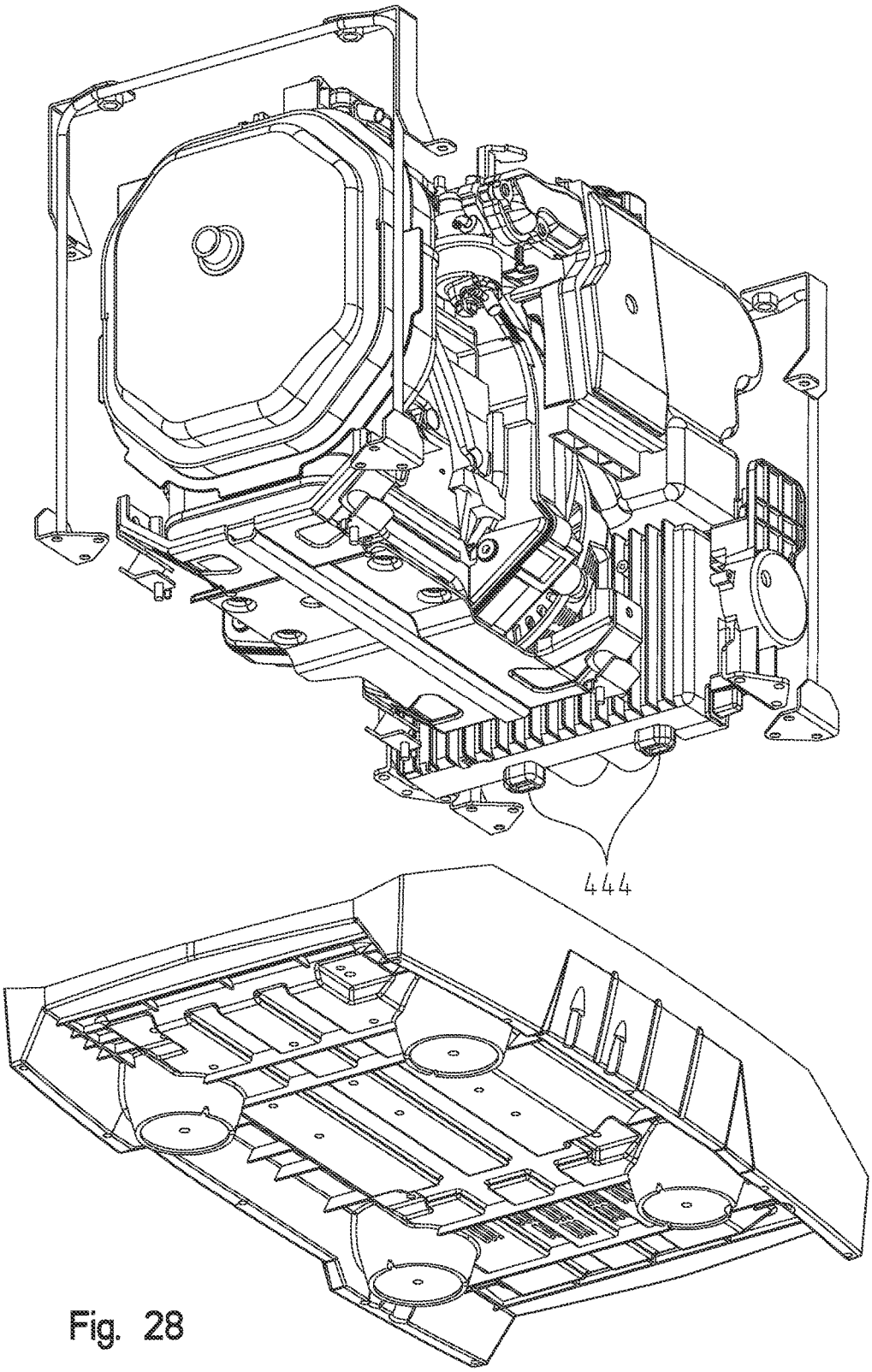
FIG. 28 shows the engine-generator set coupled to the engine mount and poised for receipt in the lower housing base portion.

As shown in FIG. 27, frame 70 may also be coupled to the lower housing base portion 10 by positioning lower brackets 376, and more particularly, apertures 376*c* in alignment with apertures 92 (FIG. 12) of bosses 90. Threaded fasteners may be received through each of the apertures 376*c* fastening the frame 70 to the lower housing base portion 10. The middle housing portion 14, preassembled as described above, may now be slidably received over frames 70 and engine-generator 6. This positions lower lip 126, 186 (FIGS. 16 and 17) in groove 80 (FIG. 12) this also positions slotted openings 168 (FIG. 17) over aperture 378*d* (FIG. 27), whereby a threaded fastener may be received to couple the middle housing 14 to frame 70.

Figure 30:
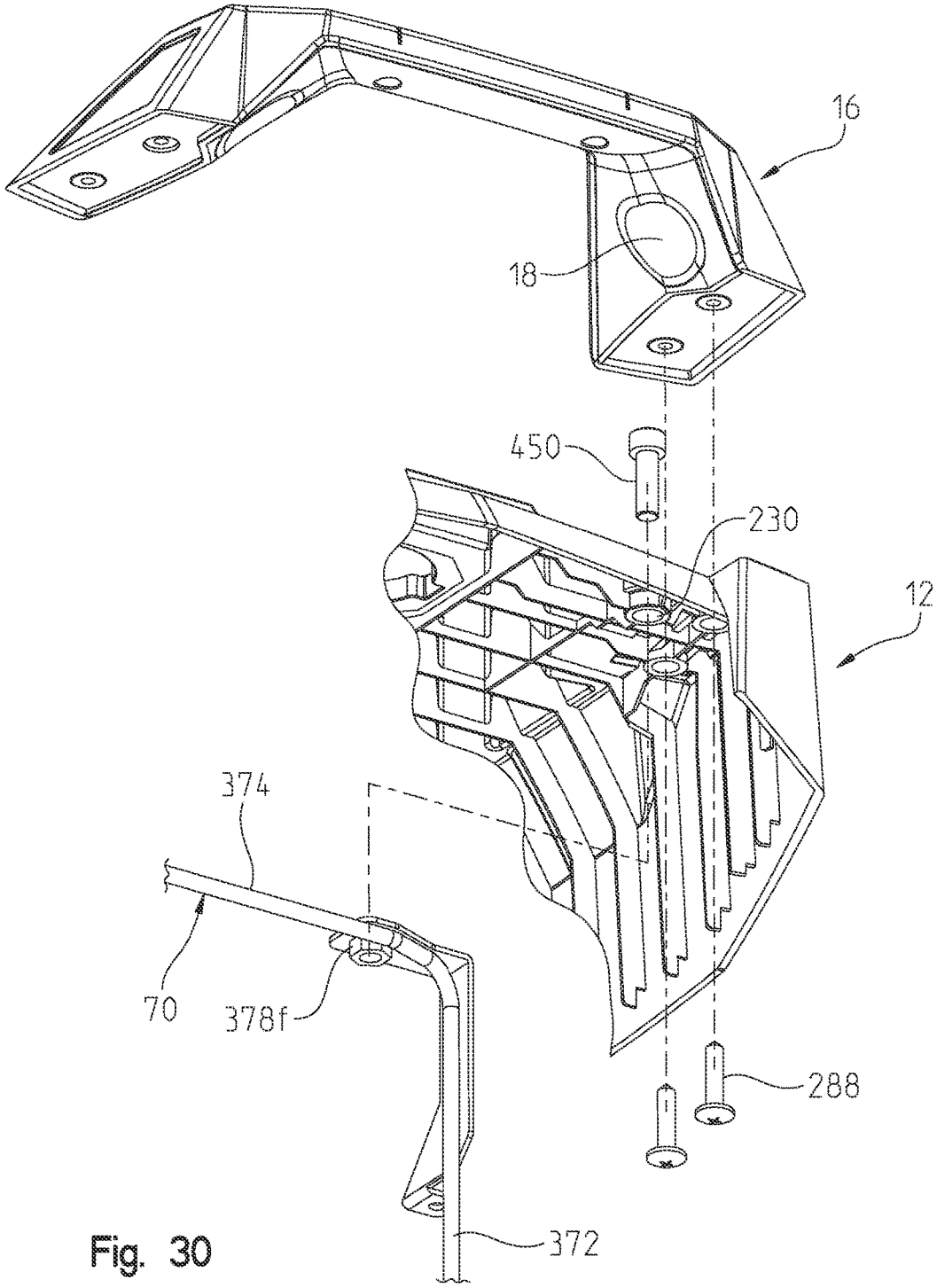
FIG. 30 is fragmentary view of the upper cover, handle and frame.

Finally, and with respect to FIG. 30, upper cover member 12 may now be coupled to frame 70 by positioning upper cover member 12 over, and against, mid-housing portion. As mentioned above, handle 16 is preassembled to upper cover member 12 by way of fasteners 288, which are positioned on an inside of upper cover member 12. However, aperture 18 together with aperture 268 (FIG. 22), aligns with aperture 230 from a top thereof (see FIG. 7) such that fastener 450 (FIG. 30) may be received through aperture 18 into aperture 230 whereupon it is received through threaded fastener 378*f*.

By providing the engine mount 66 with the isolation mount 302, the engine vibration is dissipated, having little to no vibration at the outer housing 4. By providing the frame 70 between the upper cover and the lower housing base portion 10, the forces in the handle 16 (from the weight of the generator 2) are transferred to the lower housing base portion 10 through the frame 70.

Figure 5:
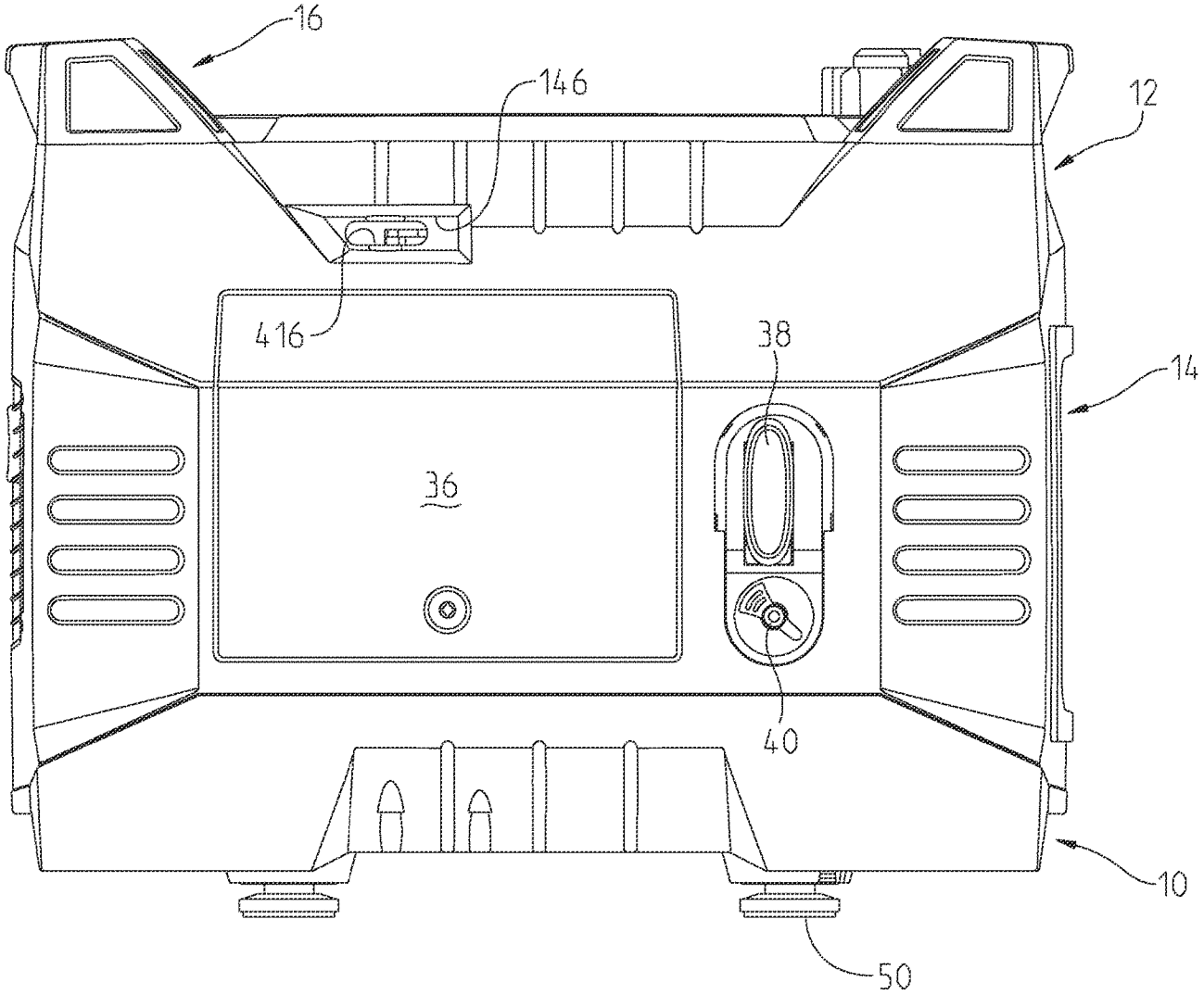
FIG. 5 is a left-side view of the portable generator of FIG. 1.
Figure 6:
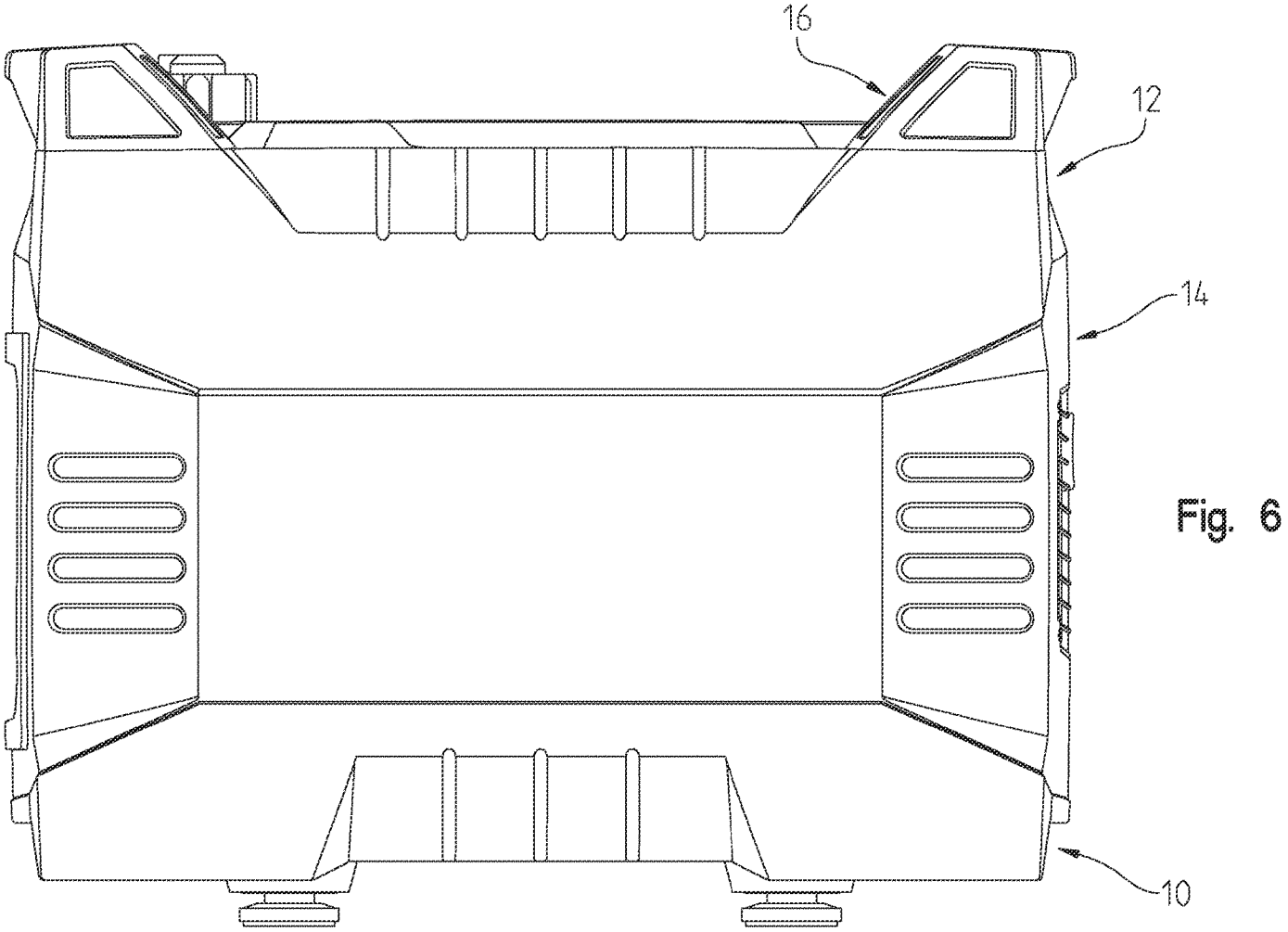
FIG. 6 is a right-side view of the portable generator of FIG. 1.
Figure 7:
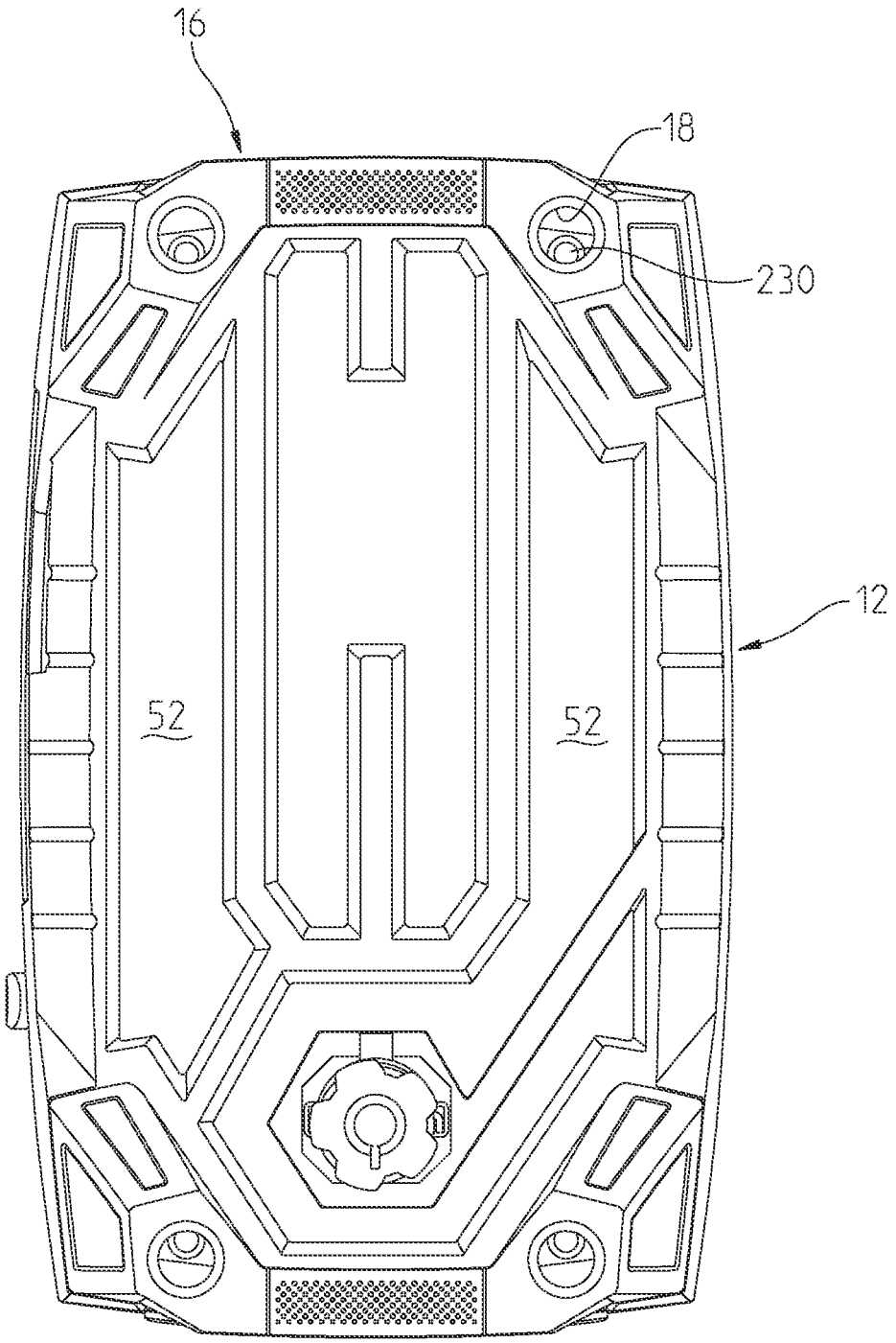
FIG. 7 is a top-plan view of the portable generator of FIG. 1.
Figure 8:
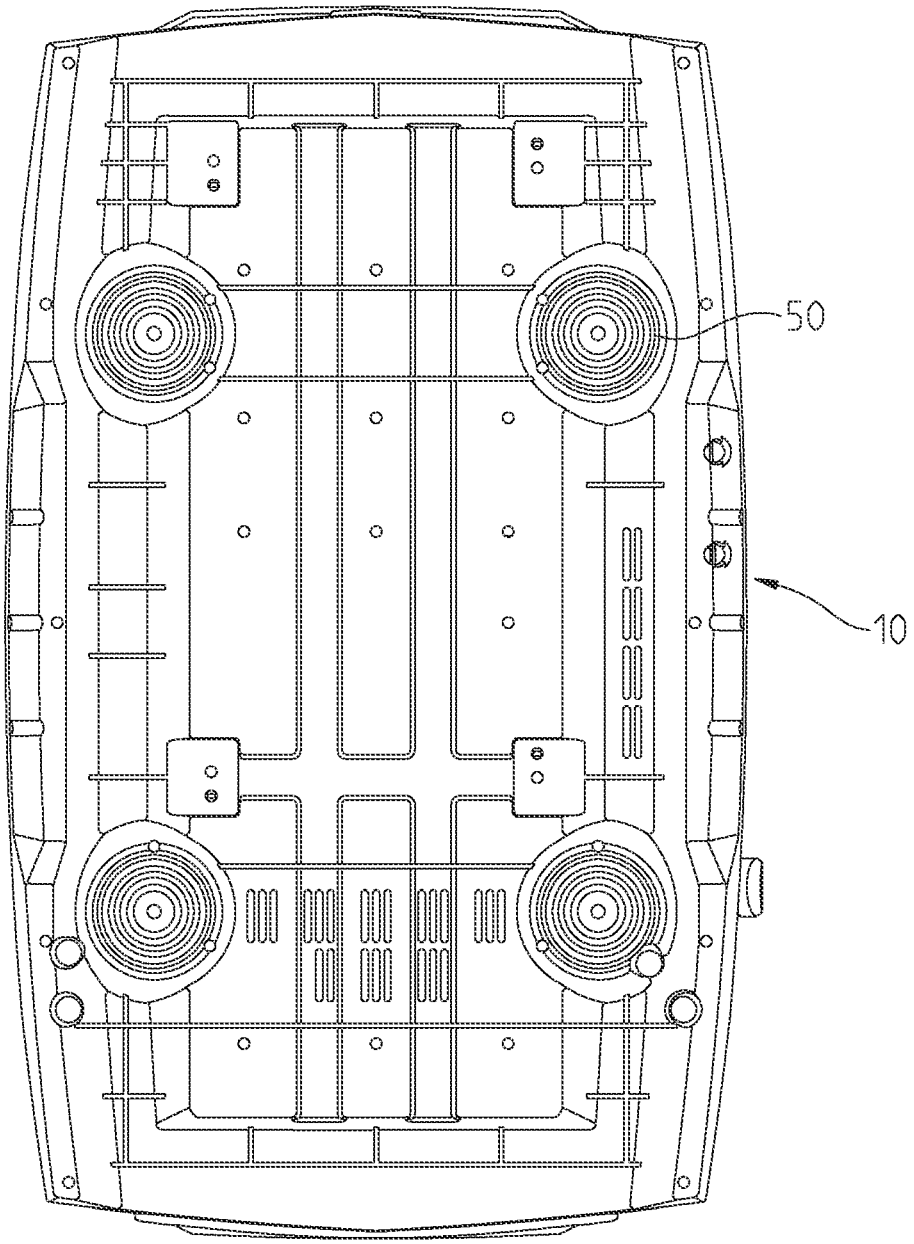
FIG. 8 is a bottom view of the portable generator of FIG. 1.

As assembled, housing 4 is positioned over and encloses the engine-generator 6. Certain features of the engine are accessible through the housing 4. For example, the engine dipstick 460 (FIG. 26) is accessible by removing the service door 36 (FIG. 5) as described above. Also the fuel filler neck 422 and cap 420 (FIG. 29) are accessible through the opening 240 (FIG. 19). Also throttle 416 is accessible through window 146 (FIG. 5).

Figure 31:
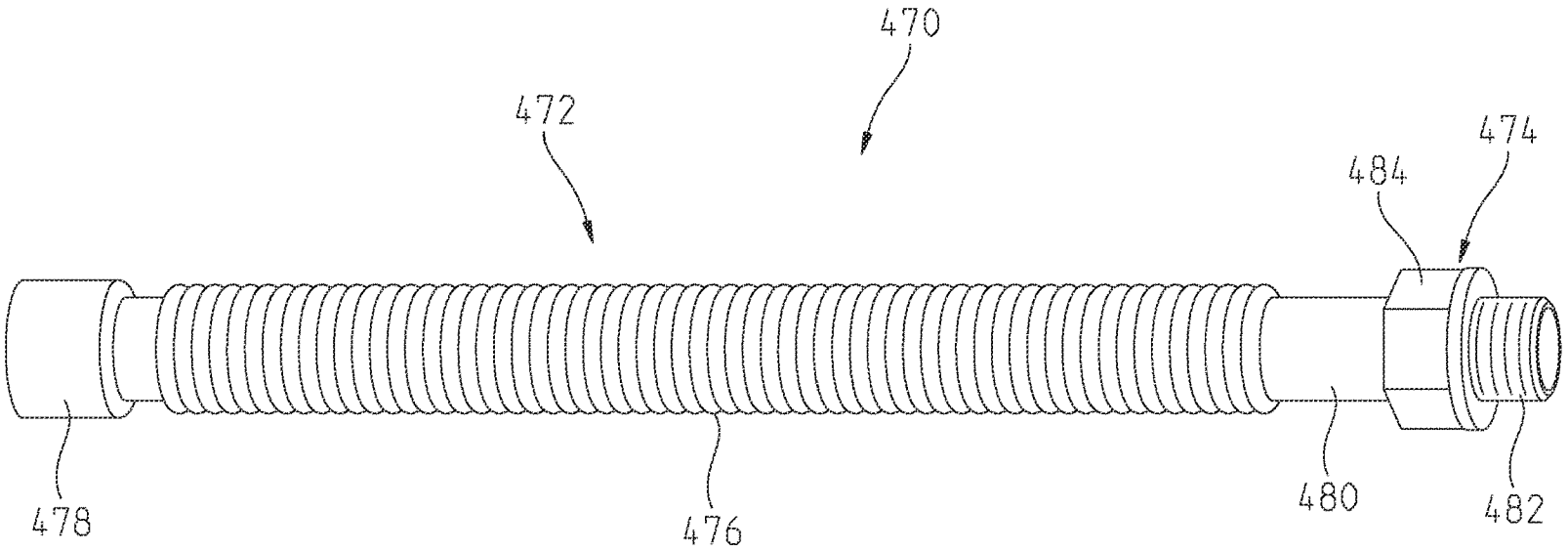
FIG. 31 is a side view of an optional oil filler tube.
Figure 32:
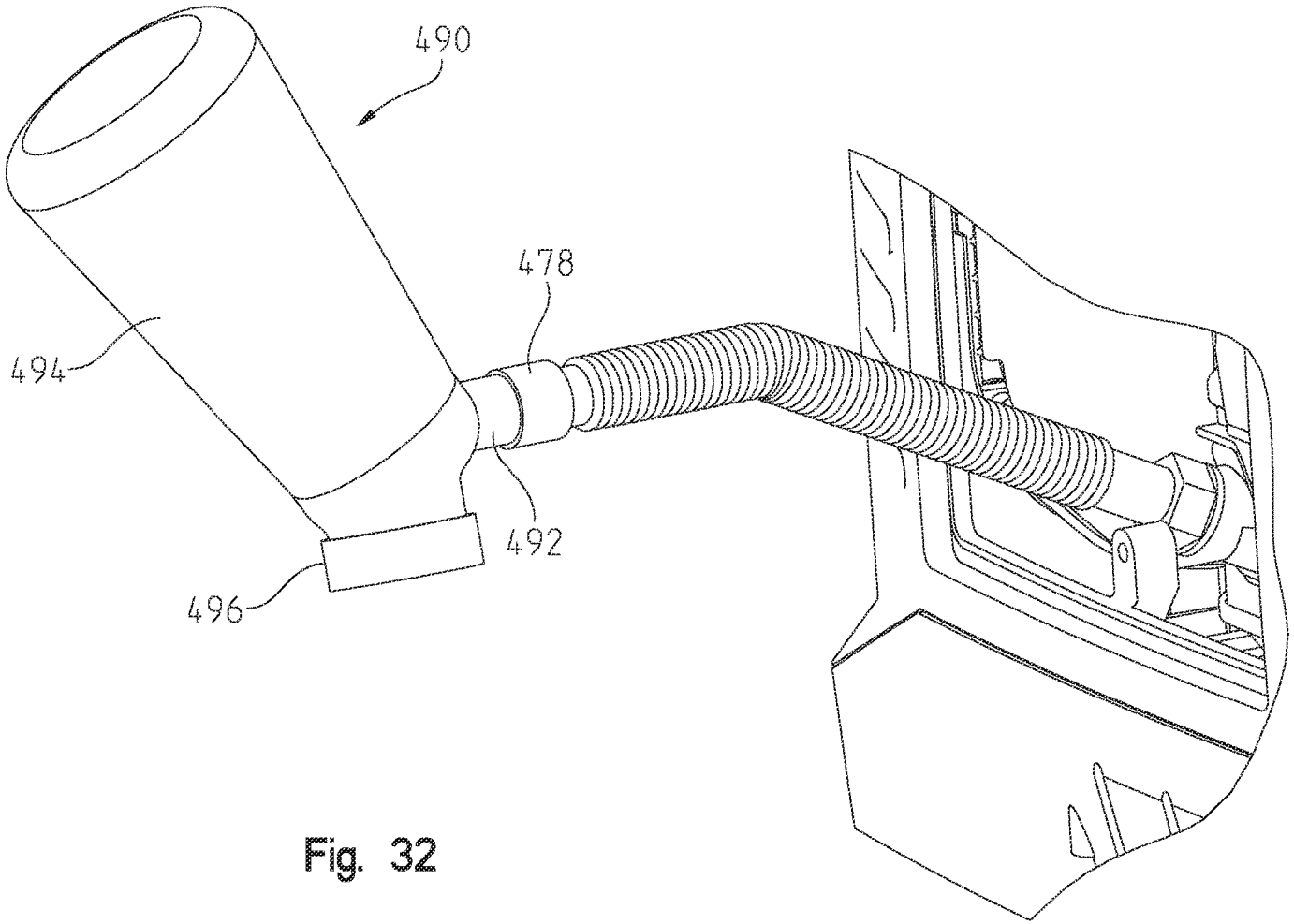
FIG. 32 shows a perspective view of the oil filler tube coupled to the oil drain hole.
Figure 33:
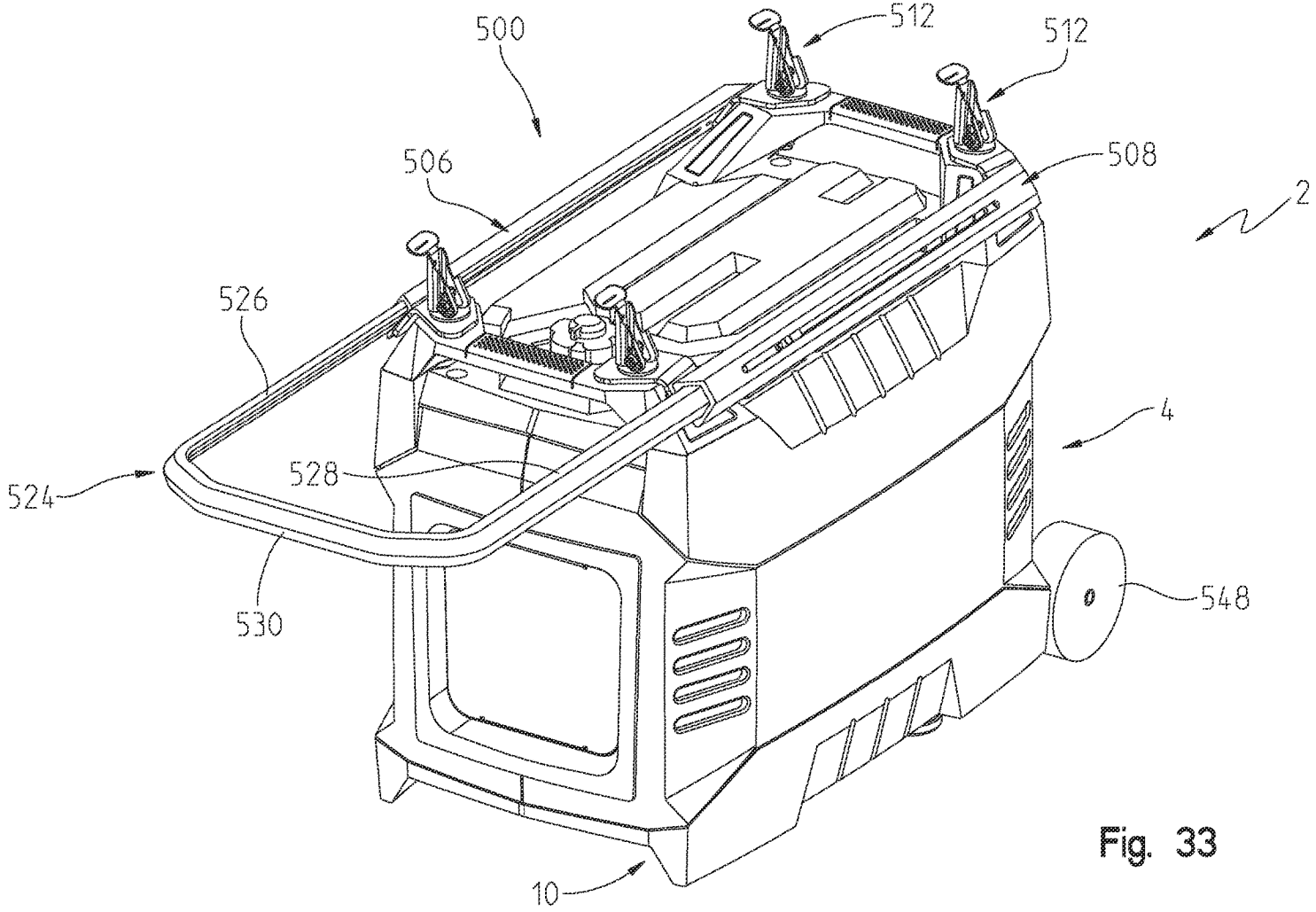
FIG. 33 is a perspective view illustrating another embodiment of a portable generator which includes an attached handle assembly and wheels to facilitate movement of the portable generator, with a handle shown in an extended position.
Figure 34:
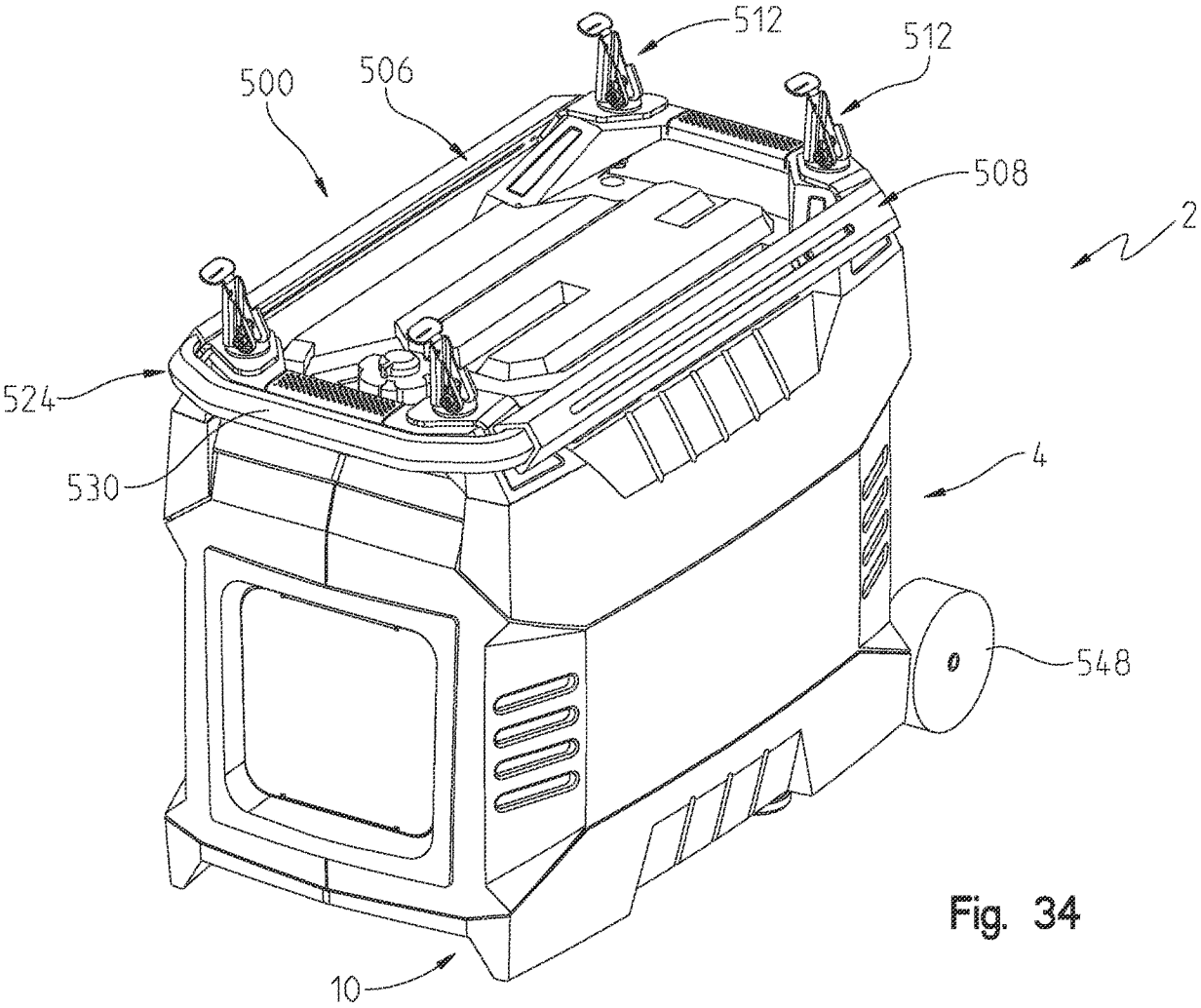
FIG. 34 is a perspective view similar to FIG. 33 showing the handle in a retracted position.

With reference now to FIGS. 31 and 32, an optional oil fill and drain tube assembly will now be described. As shown first in FIG. 31, the assembly includes a fill tube shown generally at 470 including a tube portion 472 and a fitting 474. Tube portion 472 is comprised of a central corrugated portion 476 allowing the tube portion to be flexible relative to a longitudinal axis of the tube. A top or outer end 478 is internally threaded to receive an oil canister as further described herein. An opposite end of tube 476 includes a sealed end 480, which is coupled to the fitting 474. Fitting 474 includes a threaded end 482, which matches the thread on the dipstick. Fitting 474 also includes a hexagonal portion 484 to be used with a wrench to assist in installing fitting 474.

With reference now to FIG. 32, an oil canister 490 is provided having a threaded end 492, which matches the thread on hose outer end 478. Canister 490 includes a central volume portion 494 and a cap 496.

Thus, to drain the oil from generator 2, dipstick 460 is removed from engine 400 and fitting 474 is threaded into the dipstick hole. Canister 490 is then threaded onto hose end 478 whereupon generator 2 can be tipped to drain the oil into canister 490. Once the oil has drained, the canister 490 can be removed and the oil can be discarded. To add new oil, the oil is placed in the central volume portion 494 of canister 490 and the reverse process takes place where canister 490 is connected to hose 472, generator 2 is positioned upright and canister 490 is tipped upwardly to allow oil to drain from canister 490 through hose 472 back into the engine crank case. Canister 490 could have a fill line, which corresponds to the oil capacity of the engine to ensure that the proper amount of oil is added to the engine.

Another embodiment of the present disclosure is shown in FIGS. 33-37. A handle assembly 500 is coupled to a top portion of the upper cover portion 12 of housing 4 to facilitate movement of the portable generator 2. A wheel assembly 502 is coupled to a bottom of lower housing base portion 10 to further facilitate movement of the portable generator 2.

Figure 37:
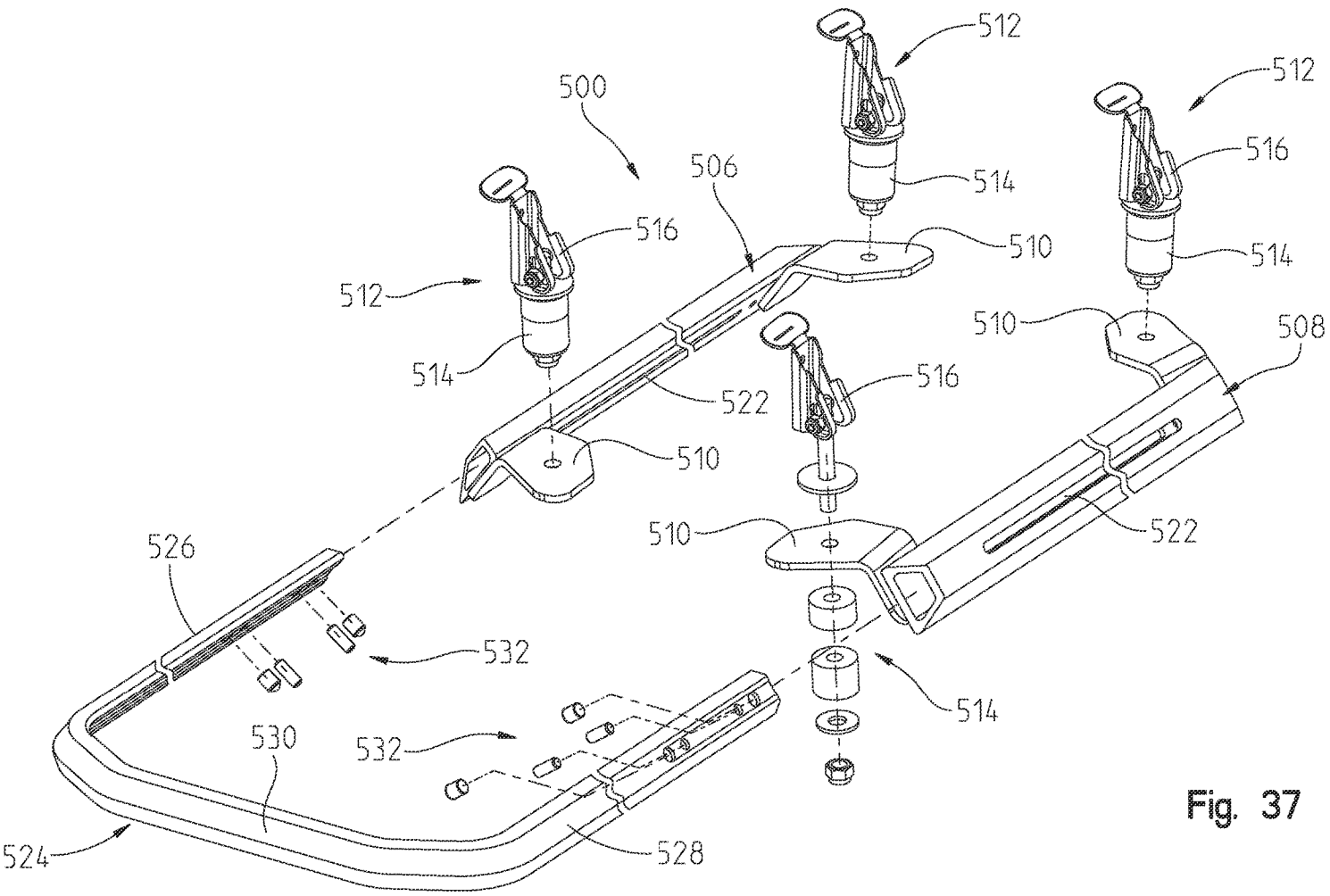
FIG. 37 is an exploded perspective view of the handle assembly shown in FIGS. 33-36.

The handle assembly 500 includes a frame having first and second fixed frame members 506 and 508. Each of the first and second fixed frame members 506 and 508 includes mounting tabs 510 for receiving fasteners 512 to secure the frame members 506 and 508 to the housing 4. In an illustrated embodiment, the fasteners 512 are illustratively Lock & Ride® locking members each including an expansion anchor 514 and pivotable actuator 516. When the actuator 516 is pivoted to a downward position, the expansion anchor 514 expands within apertures 18 of handles 16 to secure the handle assembly 500 to the housing 4 of portable generator 2. Illustratively, the four expansion anchors 514 are first located within apertures 18 of handles 16. The actuators 516 are then actuated to expand the expansion anchors 514 to secure the handle assembly 500 to the housing 4. Details of the fasteners 512 are best shown in FIG. 37. It is understood that other types of suitable fasteners may be used to secure the handle assembly 500 to the housing 4.

Frame members 506 and 508 are elongated frame members having longitudinally extending central openings. Frame members 506 and 508 further include elongated slots 522. A generally U-shaped handle 524 includes side legs 526 and 528. The side legs 526 and 528 are slidably received within the longitudinal openings of frame members 506 and 508, respectively. A center portion 530 of handle 524 connects the first and second side legs 526 and 528. A plurality of pins 532 are coupled to side legs 526 and 528. Pins 532 are located within the elongated slots 522 of frame members 506 and 508 to limit movement of the movable handle 524 relative to the frame members 506 and 508. The movable handle 524 is movable from an extended position shown in FIG. 33 to a retracted position shown in FIG. 34. In the extended position, an operator can grip the center handle portion 530 to facilitate movement of the portable generator 2.

Figure 35:
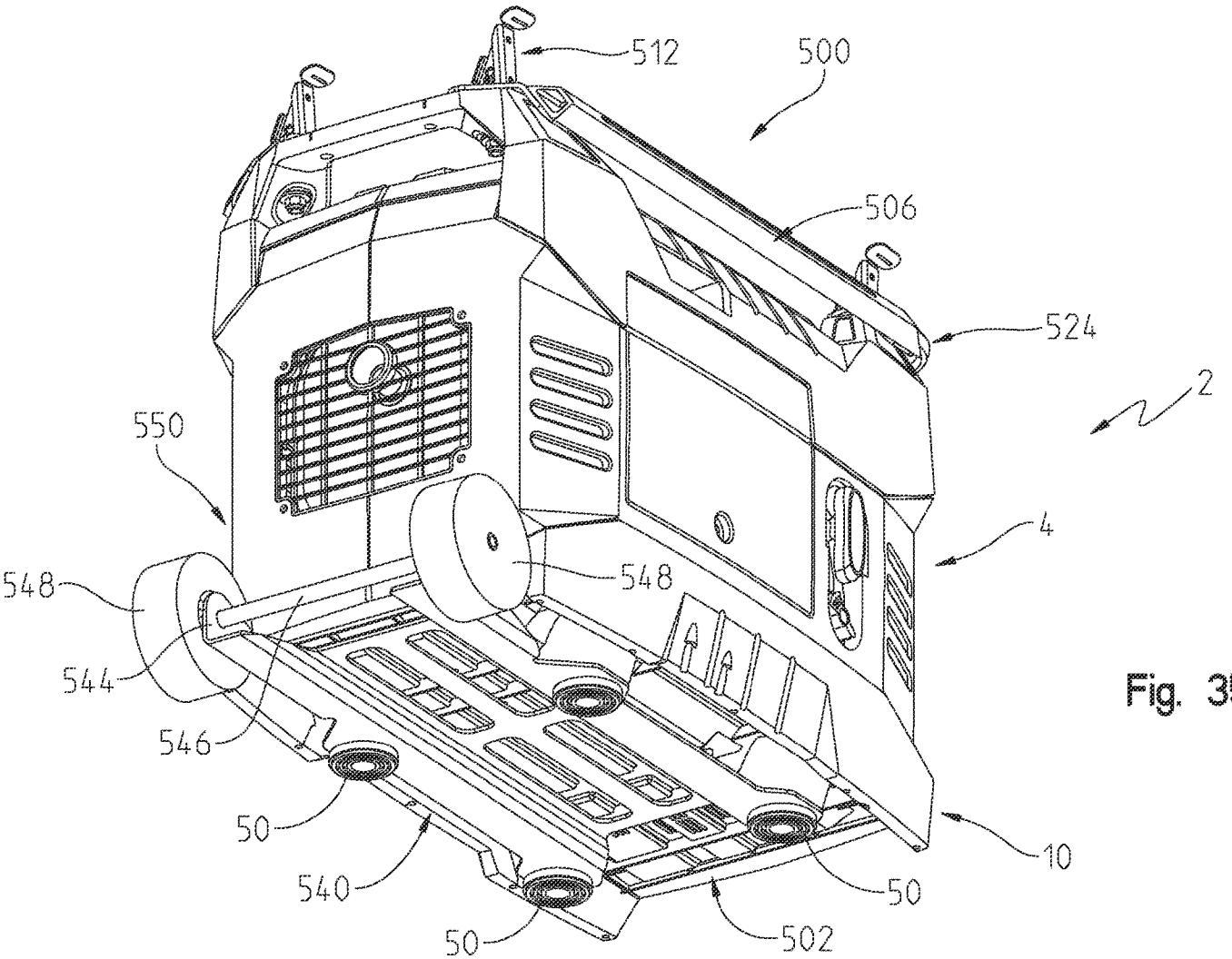
FIG. 35 is a bottom perspective view of the embodiment of FIGS. 33 and 34, illustrating a wheel assembly coupled to a bottom portion of the portable generator.
Figure 36:
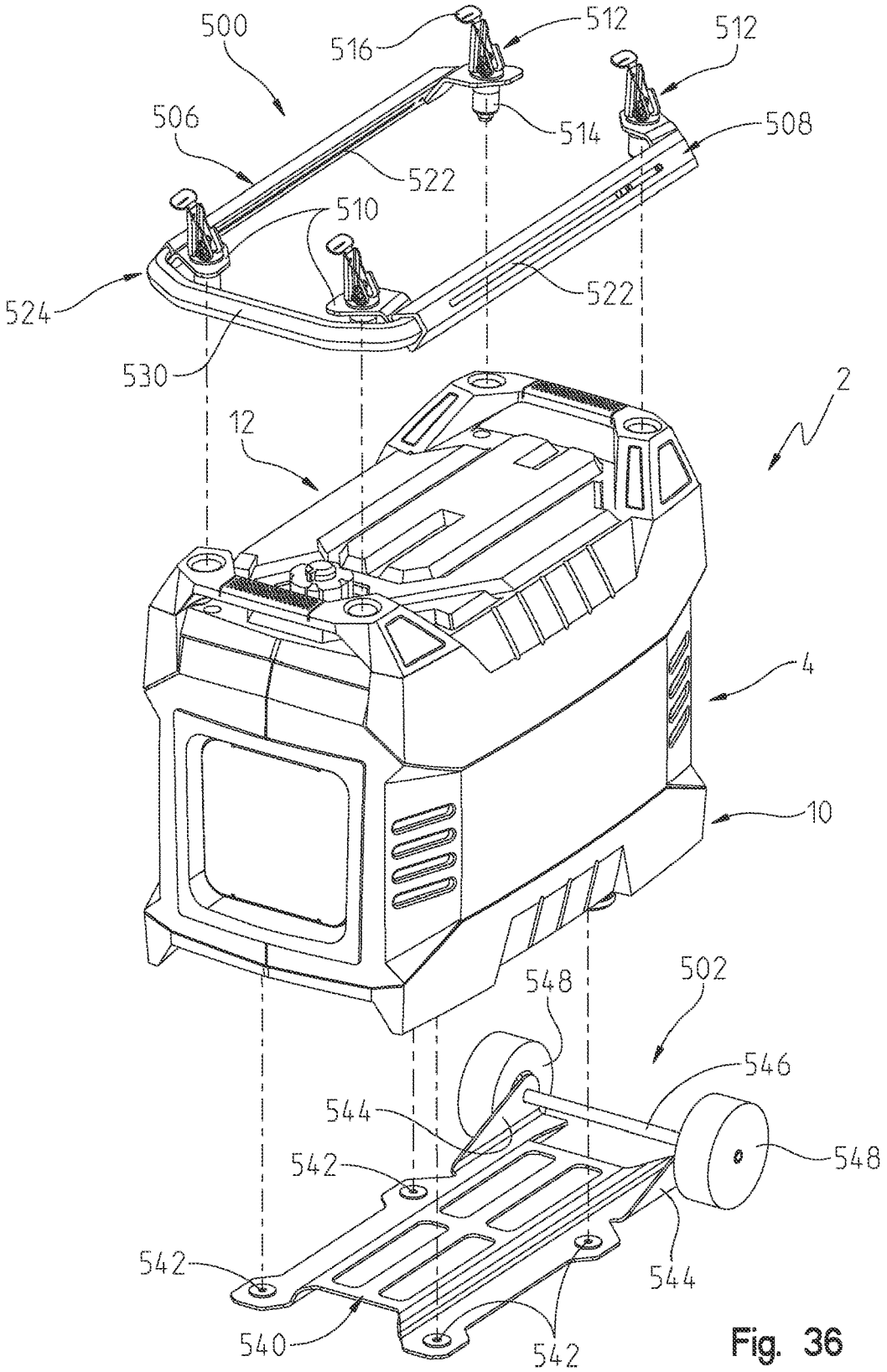
FIG. 36 is an exploded perspective view of the portable generator of FIG. 34.

The wheel assembly 502 is best illustrated in FIGS. 35 and 36. Wheel assembly 502 includes a base 540 having a plurality of mounting portions 542. Upwardly extending flanges 544 are located at one end of the base 540. An axle 546 extends through openings in the flanges 544. Wheels 548 are coupled to opposite ends of axle 546.

Wheel assembly 502 is coupled to lower housing base portion 10 so that wheels 548 are located adjacent a rear portion 550 of housing 4 of portable generator 2 as best shown in FIG. 35. Wheels 548 facilitate movement of the portable generator 2. In operation, the movable handle portion 524 is moved from its retracted position of FIG. 34 to its extended position of FIG. 33. A user then grips the center portion 530 of handle 524 and pivots the portable generator 2 upwardly onto wheels 548 so that the portable generator rolls easily over a surface 48 to the base portion 540. As shown in FIG. 35, the base portion 540 of wheel assembly 502 is coupled to the lower housing base portion 10 by the feet 50 which extend through mounting portions 542 and into openings 106 located in the lower housing base portion 10.

Figure 38:
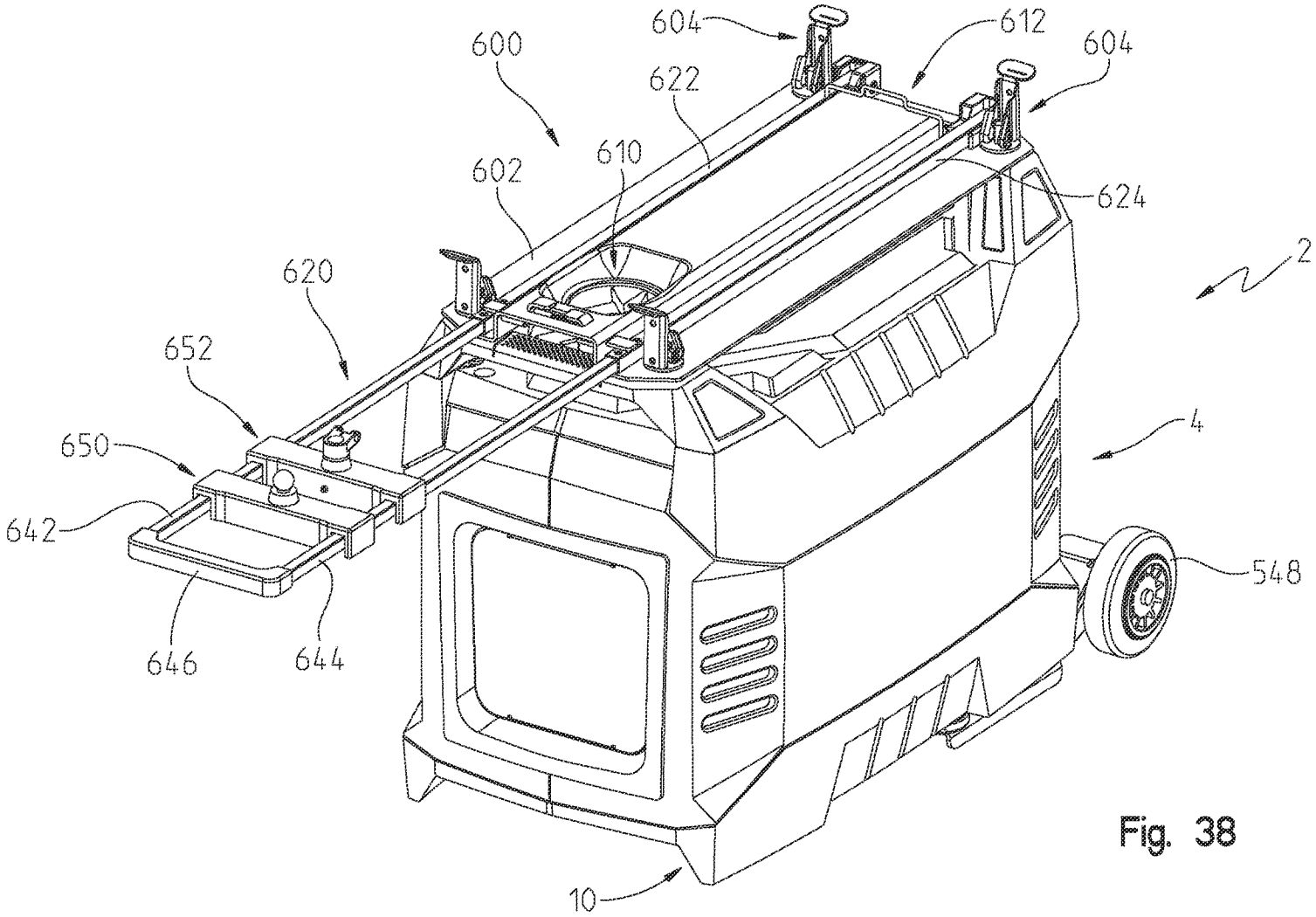
FIG. 38 is a perspective view of another embodiment of a portable generator of the present disclosure including another embodiment of an extendable and pivotable handle assembly coupled to the top portion of the housing of the portable generator.
Figure 39:
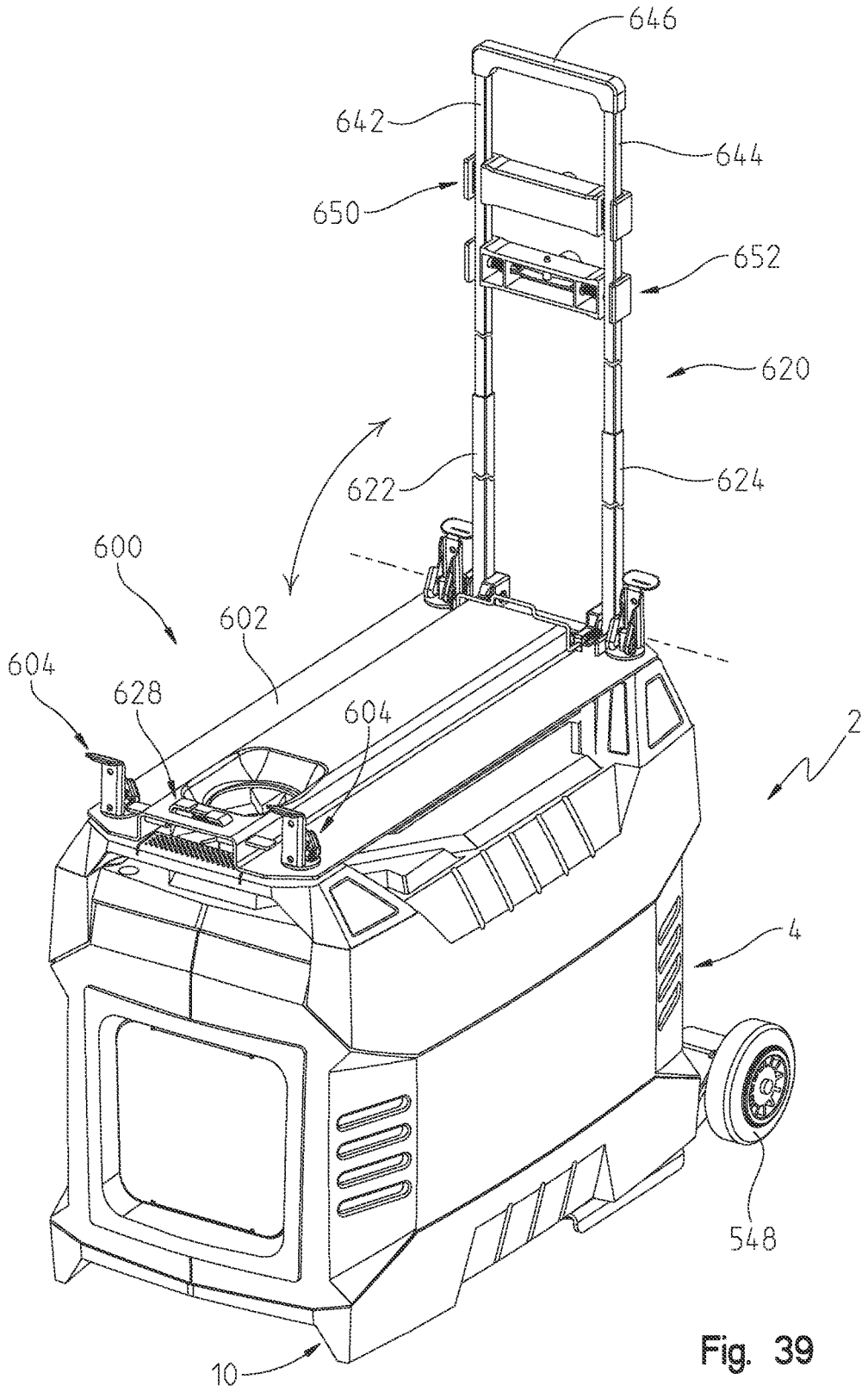
FIG. 39 is a perspective view of the embodiment of FIG. 38, showing a handle pivoted upwardly to support an accessory item.
Figure 40:
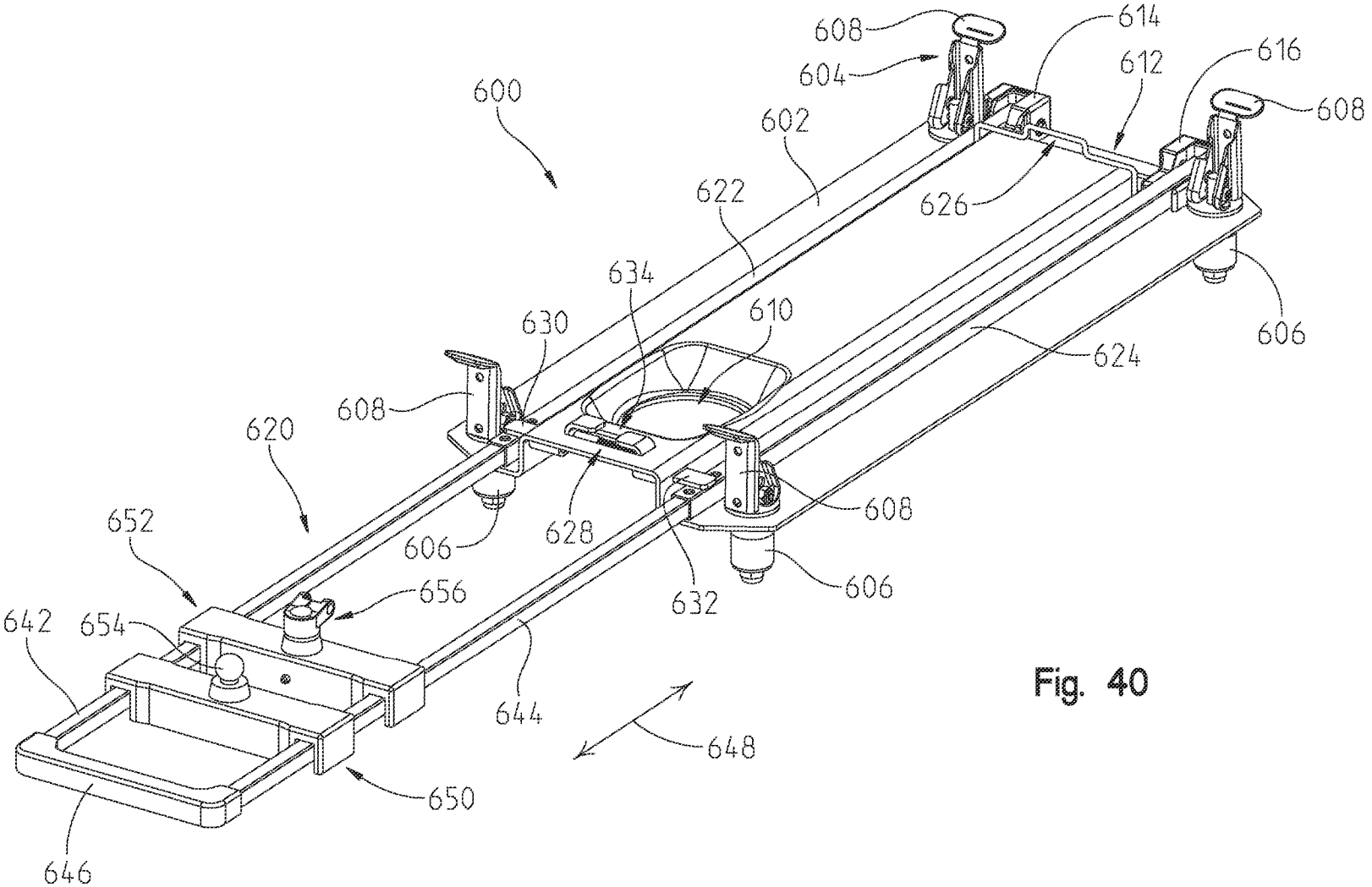
FIG. 40 is a perspective view showing additional details of the handle assembly of FIGS. 38 and 39.

Another embodiment of the present disclosure is illustrated in FIGS. 38-40. In this embodiment, a different style handle assembly 600 is coupled to an upper portion of housing 4. As best shown in FIG. 40, the handle assembly 600 includes a base 602 having four fastening members 604 coupled thereto. Fastening members 604 are illustratively Lock & Ride® locking members including an expansion anchor 606 and an actuator 608 as discussed above. Expansion members 606 are located within apertures 18 of handles 16 and then expanded using the actuator 608 to secure the handle assembly 600 to the housing 4 of portable generator 2. It is understood that other types of suitable fasteners may be used to secure the handle assembly 600 to the housing 4.

Base 602 includes an opening 610 configured to receive a portion of fuel cap 420 therethrough. Base 602 also includes a pivot mounting portion 612 having connectors 614 and 616 located at one end of the base 602. A pivotable handle includes first and second legs 622 and 624 pivotably coupled to mounting portion 614 and 616, respectively by pivot pins. A locking mechanism is provided for selectively locking the handle in a first position aligned generally parallel to the top surface of the housing 4 shown in FIGS. 38 and 40 or in an upwardly pivoted position aligned transverse to the top surface of the housing 4 shown in FIG. 39. A release bar 626 is provided to selectively release the locking mechanism to permit pivotal movement of the handle relative to the base 602 between the first position and the upwardly pivoted position.

A second locking mechanism 628 is provided at an opposite end of the base 602 to hold the handle in the first position of FIGS. 38 and 40. Illustratively, tabs 630 and 632 are located over the frame members 622 and 624, respectively, when the locking mechanism 628 is locked. An actuator 634 is provided to withdraw the tabs 630 and 632 to permit pivotal movement of the handle relative to the housing.

A generally U-shaped handle portion 620 has first and second legs 642 and 644 which are slidably coupled to legs 622 and 624. A central gripping portion 646 is located between the side legs 642 and 644 of movable handle 620. Handle portion 620 is movable in the direction double headed arrow 648 from a retracted position (not shown) to an extended position as shown in FIGS. 38-40.

In the downward and locked first position shown in FIG. 38, the movable handle 620 is extendable to facilitate transport of the portable generator 2 by pulling the generator 2 on wheels 548. As discussed above, frame members 622 and 624 of handle are pivotable upwardly to the position of FIG. 39. In the upwardly pivoted position, the movable handle 620 can be extended to a desired height. Accessory mounting members 650 and 652 are then coupled to the movable handle 620 for mounting accessories such as lights, cameras, or other equipment to the generator 2. Accessories can then be plugged in to the generator to provide power to the accessories.

Mounting members 650 and 652 include accessory attachment portions 654 and 656, respectively. It is understood that any suitable type of attachment mechanism for accessories may be coupled to the mounting members 650 and 652.

Figure 41:
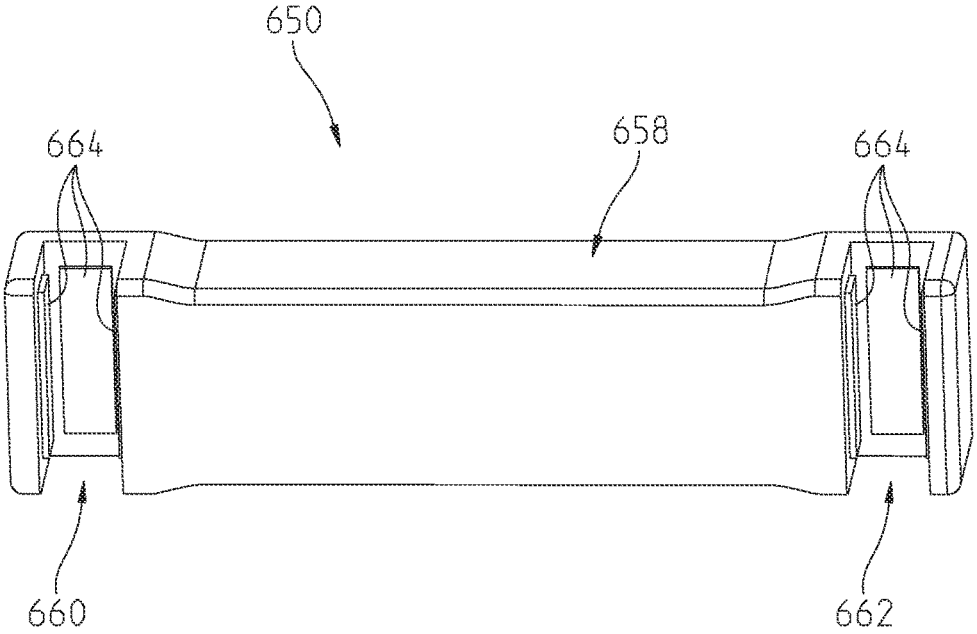
FIG. 41 is a perspective view showing an accessory mounting device configured to be coupled to the handle of the portable generator of FIG. 38-40.

Details of the first mounting member 650 are shown in FIG. 41. The mounting member 650 includes a body portion 658 and openings 660 and 662. The openings 660 and 662 are spaced apart by the same distance as side legs 642 and 644 of movable handle 620. Compressible tabs 664 surround the openings 660 and 662 to provide a compression fit between the mounting member 650 and side members 642 and 644 of handle 620 to secure the mounting member 650 to the handle 620.

Figure 42:
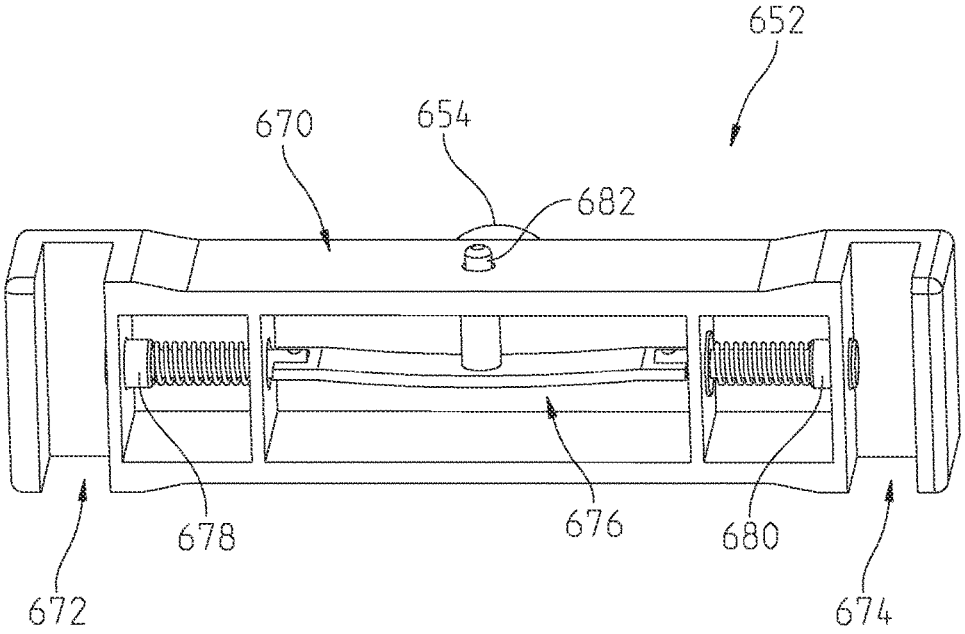
FIG. 42 is a perspective view of another embodiment of an accessory mounting device configured to be coupled to the handle of the embodiment of FIGS. 38-40.

Mounting member 652 is best illustrated in FIG. 42. Mounting member 652 includes a body portion 670 having openings 672 and 674 which are spaced apart by the same distance as side legs 642 and 644 of movable handle 620. A spring biased retention mechanism includes first and second locking pins 678 and 680 which are spring loaded to enter into openings 672 and 674, respectively. An actuator 682 is provided to withdraw the pins 678 and 680 from the openings 672 and 674. In one embodiment, the pins 678 and 680 are configured to enter openings within side legs 642 and 644, respectively, of movable handle 620. In another embodiment, the pins 678 and 680 provide a friction fit to retain the mounting member 652 on the handle 620.

One or both of the mounting members 650 and 652 may be used on the handle 620, as desired. Once the mounting members 650 and 652 are positioned at the desired locations, accessory is attached to the mounting members 650 and 652 and connected to the power supply.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A portable engine-generator, comprising:

an engine;

a generator coupled to the engine;

an engine mount comprising a mounting plate coupled to the engine;

an outer housing comprising at least a lower housing base portion and an upper cover portion, the mounting plate being coupled to the lower housing base portion;

a frame coupled to the lower housing base portion, the frame having vertical portions extending upwardly from the lower housing base portions, and the upper cover portion being coupled to the vertical portions;

at least one handle coupled to the upper cover portion;

at least one handle frame coupled to the at least one handle and to the frame; and the frame is coupled to the at least one handle, the lower housing base portion and the upper cover portion, where the handle and handle frame are coupled to an outside surface of the upper cover portion and the frame is coupled to an inside surface of the upper cover portion;

wherein the weight load of the engine and generator is supported by the lower housing base portion and the weight load at the handle is reinforced through the frame, the upper cover portion and handle frame.

2. The portable engine-generator of claim 1, wherein the engine mount further comprises an isolation mount coupled between the mounting plate and the lower housing base portion.

3. The portable engine-generator of claim 2, wherein isolation mount comprises two bracket portions coupled by a rubber isolation member.

4. The portable engine-generator of claim 3, wherein an upper bracket portion is coupled to the engine-generator and a lower bracket is coupled to the lower housing base portion.

5. The portable engine-generator of claim 1, wherein the outer housing further comprises a middle housing portion coupled to the lower housing base portion and the upper cover portion and the outer housing substantially surrounds the engine, generator and frame.

6. The portable engine-generator of claim 5, wherein the middle housing portion is also coupled to the frame.

7. The portable engine-generator of claim 6, wherein the middle housing portion includes a removable service window accessing service points on the engine.

8. The portable engine-generator of claim 1, wherein the frame comprises a generally vertically upstanding frame member.

9. The portable engine-generator of claim 8, wherein the frame comprises at least two generally vertically upstanding frame members positioned at opposite ends of the engine-generator.

10. The portable engine-generator of claim 8, wherein the generally vertically upstanding frame member includes has an inverted U-shape.

11. The portable engine-generator of claim 10, wherein the generally vertically upstanding frame member includes an inverted U-shaped rod having lower brackets coupled to the lower housing base portion.

12. The portable engine-generator of claim 8, wherein the frame further comprises upper brackets for coupling to the upper cover portion.

13. The portable engine-generator of claim 1, wherein the handle is coupled to the upper cover portion by way of fasteners.

14. The portable engine-generator of claim 13, wherein the handle comprises an aperture therethrough which accesses the fastener which couples the handle to the upper cover portion.

15. The portable engine-generator of claim 14, wherein the aperture is profiled as a cylinder having an inner cylindrical surface.

16. The portable engine-generator of claim 1, further comprising a second handle coupled to the upper cover portion.

17. A portable engine-generator, comprising:

an engine;

a generator coupled to the engine;

an engine mount comprising a mounting plate coupled to the engine;

a generally vertically upstanding frame member having an inverted U-shape and having lower brackets coupled to the lower housing base portion;

an outer housing surrounding the frame, substantially enclosing the engine, generator and frame, the outer housing comprising at least a lower housing base portion, a middle housing section and an upper cover portion, the mounting plate being coupled to the lower housing base portion; and at least one handle coupled directly to the upper cover portion.

18. The portable engine-generator of claim 17, wherein the handle is coupled to the outer housing by way of fasteners.

19. The portable engine-generator of claim 18, wherein the handle comprises an aperture therethrough which accesses the fastener which couples the handle to the outer housing.

20. The portable engine-generator of claim 19, wherein the aperture is profiled as a cylinder having an inner cylindrical surface.

21. The portable engine-generator of claim 17, wherein the handle and handle frame are coupled to the upper cover portion.

22. The portable engine-generator of claim 17, wherein the outer housing further comprises a middle housing portion coupled to the lower housing base portion and the upper cover portion.

23. The portable engine-generator of claim 22, wherein the middle housing portion is also coupled to the frame.

24. The portable engine-generator of claim 23, wherein the middle housing portion includes a removable service window accessing service points on the engine.

25. The portable engine-generator of claim 17, wherein the engine mount further comprises an isolation mount coupled between the mounting plate and the lower housing base portion.

26. The portable engine-generator of claim 25, wherein the isolation mount comprises two bracket portions coupled by a rubber isolation member.

27. The portable engine-generator of claim 26, wherein an upper bracket portion is coupled to the engine-generator and a lower bracket is coupled to the lower housing base portion.

28. The portable engine-generator of claim 17, wherein the frame comprises at least two generally vertically upstanding frame members positioned at opposite ends of the engine-generator.

29. The portable engine-generator of claim 28, wherein the generally vertically upstanding frame member includes an inverted U-shaped rod.

30. The portable engine-generator of claim 29, wherein the frame further comprises upper brackets for coupling to the upper cover portion.

31. The portable engine-generator of claim 17, further comprising at least two wheels coupled to a bottom portion of the outer housing, and wherein the handle includes a first handle portion coupled to a top portion of the outer housing, and a second handle portion moveable relative to the first handle portion from a retracted position to an extended position.

32. A portable engine-generator, comprising:

an engine;

a generator coupled to the engine;

an engine mount comprising a mounting plate coupled to the engine;

a frame;

an outer housing surrounding the engine, generator and frame, the outer housing comprising at least a lower housing base portion and an upper cover portion, the mounting plate being coupled to the lower housing base portion;

at least one handle coupled directly to the upper cover portion;

at least two wheels coupled to a bottom portion of the outer housing, and wherein the handle includes a first handle portion coupled to a top portion of the outer housing, and a second handle portion moveable relative to the first handle portion from a retracted position to an extended position, wherein the first handle portion includes first and second frame members having longitudinal openings therein coupled to the top portion of the outer housing, and the second handle portion includes first and second spaced apart legs slidably received in the openings of the first and second frame members, respectively.

33. The portable engine-generator of claim 32, wherein the first and second frame members are secured in a fixed position relative to the outer housing.

34. The portable engine-generator of claim 32, wherein the first and second frame members are pivotably coupled to the outer housing so that the handle is movable from a first position aligned generally parallel to the top surface of the outer housing and a second upwardly pivoted position aligned transverse to the top surface of the outer housing.

35. The portable engine-generator of claim 34, further comprising a mounting member coupled to the handle, the mounting member including an accessory attachment portion to secure an accessory item to the handle.

36. A portable engine-generator, comprising:
an engine;
a generator coupled to the engine;
an engine mount comprising a mounting plate coupled to the engine;
a frame;
an outer housing surrounding the engine, generator and frame, and comprising at least a lower housing base portion and an upper cover portion, the mounting plate being coupled to the lower housing base portion; and wherein at least one handle is coupled to the upper cover portion; and
the frame is coupled to the at least one handle, the lower housing base portion and the upper cover portion;
wherein the weight load of the engine and generator being transferred from the handle to the lower housing base portion through the frame and
wherein the handle is secured to the outer housing by at least one expansion anchor having a pivotable actuator, each expansion anchor expanding within an aperture of the outer housing upon actuation of the actuator to secure the handle to the outer housing.

37. A portable engine-generator, comprising:
an engine;
a generator coupled to the engine;
an engine mount comprising a mounting plate coupled to the engine;
a frame;
an outer housing surrounding the engine, generator and frame, and comprising at least a lower housing base portion and an upper cover portion, the mounting plate being coupled to the lower housing base portion;
at least one handle coupled to the upper cover portion, the at least one handle having a grip portion and two feet portions;
at least one handle frame having a frame portion complementary with and reinforcing the handle grip portion, and frame feet portions complementary with and reinforcing the handle feet portions, the at least one handle frame coupled to the at least one handle and to the frame; and
the frame is coupled to the at least one handle, the lower housing base portion and the upper cover portion;
wherein the weight load of the engine and generator is supported by the lower housing base portion and the weight load at the handle is reinforced through the frame and handle frame.

38. The portable engine-generator of claim 37, wherein the at least one handle is two handles.

39. A portable engine-generator, comprising:
an engine;
a generator coupled to the engine;
an outer housing comprising at least a lower housing base portion and an upper cover portion;
a frame coupled to the lower housing base portion and upper cover portion, the frame having vertical portions extending upwardly from and coupled to corners of the lower housing base portions, and the upper cover portion being coupled to the vertical portions;
at least one handle coupled to an outside surface of the upper cover portion and frame;
wherein the weight load of the engine and generator is supported by the lower housing base portion and the weight load at the handle is reinforced through the frame, the upper cover portion and handle frame.

40. The portable engine-generator of claim 39, further comprising an engine mount wherein the engine comprises a mounting plate coupled to the engine.

41. The portable engine-generator of claim 40, wherein the engine mount further comprises an isolation mount coupled between the mounting plate and the lower housing base portion.

42. The portable engine-generator of claim 41, wherein the isolation mount comprises two bracket portions coupled by a rubber isolation member.

43. The portable engine-generator of claim 39, wherein the outer housing further comprises a middle housing portion coupled to the lower housing base portion and the upper cover portion and the outer housing substantially surrounds the engine, generator and frame.

44. The portable engine-generator of claim 43, wherein the middle housing portion is also coupled to the frame.

45. The portable engine-generator of claim 39, wherein the frame comprises a generally transversely extending transverse portions coupled to the vertical portions of the frame member.

46. The portable engine-generator of claim 39, wherein the frame further comprises upper brackets for coupling to the upper cover portion.

47. The portable engine-generator of claim 39, wherein the handle is coupled to the upper cover portion by way of fasteners.

48. The portable engine-generator of claim 47, further comprising a second handle coupled to the upper cover portion, wherein one handle is coupled to vertical portions at one end and the other handle is coupled to vertical portions at an opposite end.

* * * * *